US009422666B2

(12) United States Patent
Patel et al.

(10) Patent No.: US 9,422,666 B2
(45) Date of Patent: Aug. 23, 2016

(54) TEN-SHED SEMI-DUPLEX THROUGH-AIR DRYER FABRIC

(71) Applicant: AstenJohnson, Inc., Charleston, SC (US)

(72) Inventors: Rae Patel, Neenah, WI (US); Derek Chaplin, Ottawa (CA)

(73) Assignee: AstenJohnson, Inc., Charleston, SC (US)

( * ) Notice: Subject to any disclaimer, the term of this patent is extended or adjusted under 35 U.S.C. 154(b) by 144 days.

(21) Appl. No.: 14/347,432

(22) PCT Filed: Sep. 25, 2012

(86) PCT No.: PCT/US2012/057003

§ 371 (c)(1),
(2) Date: Mar. 26, 2014

(87) PCT Pub. No.: WO2013/048992

PCT Pub. Date: Apr. 4, 2013

(65) Prior Publication Data

US 2014/0231039 A1 Aug. 21, 2014

Related U.S. Application Data

(60) Provisional application No. 61/539,646, filed on Sep. 27, 2011.

(51) Int. Cl.

| | |
|---|---|
| ***D21F 1/10*** | (2006.01) |
| ***D21F 7/12*** | (2006.01) |
| ***D03D 11/02*** | (2006.01) |
| ***D21F 1/00*** | (2006.01) |

(52) U.S. Cl.
CPC *D21F 7/12* (2013.01); *D03D 11/02* (2013.01); *D21F 1/0027* (2013.01)

(58) Field of Classification Search
CPC ..... D21F 1/0027; D21F 1/0036; D21F 1/10; D21F 1/105; D21F 5/18; D21F 7/12; D21F 11/006; D21F 11/14; D21F 11/145; D21H 27/02; D21H 27/002; D03D 3/04; D03D 13/00; D03D 13/004; D03D 25/00; D03D 11/00; D03D 11/02
USPC ..... 162/116, 348, 900, 902, 903; 139/383 A, 383 AA, 425 A
See application file for complete search history.

(56) References Cited

U.S. PATENT DOCUMENTS

| | | | | |
|---|---|---|---|---|
| 5,275,700 | A | 1/1994 | Trokhan | |
| 5,429,686 | A | 7/1995 | Chiu et al. | |
| 5,449,026 | A * | 9/1995 | Lee | D21F 1/0036 139/383 A |
| 5,672,248 | A | 9/1997 | Wendt et al. | |
| 5,806,569 | A | 9/1998 | Gulya et al. | |
| 6,237,644 | B1 | 5/2001 | Hay et al. | |
| 7,300,554 | B2 | 11/2007 | LaFond et al. | |
| 7,811,627 | B2 | 10/2010 | Baker et al. | |
| 7,993,493 | B2 | 8/2011 | Quigley | |
| 2009/0065166 | A1 * | 3/2009 | Quigley | D21F 11/006 162/348 |

* cited by examiner

*Primary Examiner* — Eric Hug
(74) *Attorney, Agent, or Firm* — Volpe and Koenig, P.C.

(57) ABSTRACT

A papermaker's through-air dryer (TAD) fabric for use in the production of tissue and towel products. The fabric is woven according to a 10-shed, semi-duplex weave design in which the warp and weft yarns are arranged so as to form pockets of at least two differing sizes in a first planar fabric surface. The pockets are designed and arranged to impart a measure of bulk and absorbency to the paper products conveyed thereon by providing MD oriented recesses in the PS fabric surface into which a portion of the component fibers of the paper products formed on the fabric are deflected during manufacture.

36 Claims, 15 Drawing Sheets

| | 1 | 2 | 3 | 4 | 5 | 6 | 7 | 8 | 9 | 10 |
|---|---|---|---|---|---|---|---|---|---|---|
| 1 | 1 | 2 | | 4 | | 6 | | 8 | | 10 |
| 2 | | 2 | | 4 | | | | 8 | 9 | 10 |
| 3 | | 2 | | 4 | | 6 | 7 | 8 | | 10 |
| 4 | | | | 4 | 5 | 6 | | 8 | | 10 |
| 5 | | 2 | 3 | 4 | | 6 | | 8 | | 10 |
| 6 | 1 | 2 | | 4 | | 6 | | | | 10 |
| 7 | | 2 | | 4 | | 6 | | 8 | 9 | 10 |
| 8 | | 2 | | | | 6 | 7 | 8 | | 10 |
| 9 | | 2 | | 4 | 5 | 6 | | 8 | | 10 |
| 10 | | 2 | 3 | 4 | | 6 | | 8 | | |

| | 1 | 2 | 3 | 4 | 5 | 6 | 7 | 8 | 9 | 10 |
|---|---|---|---|---|---|---|---|---|---|---|
| 1 | | | 3 | | 5 | | 7 | | 9 | |
| 2 | 1 | | 3 | | 5 | | 7 | 8 | 9 | |
| 3 | 1 | | 3 | | | | 7 | | 9 | |
| 4 | 1 | 2 | 3 | | 5 | | 7 | | 9 | |
| 5 | 1 | | 3 | | 5 | | 7 | | | |
| 6 | 1 | | 3 | | 5 | 6 | 7 | | 9 | |
| 7 | 1 | | | | 5 | | 7 | | 9 | |
| 8 | 1 | | 3 | | 5 | | 7 | | 9 | 10 |
| 9 | 1 | | 3 | | 5 | | | | 9 | |
| 10 | 1 | | 3 | 4 | 5 | | 7 | | 9 | |

| | 1 | 2 | 3 | 4 | 5 | 6 | 7 | 8 | 9 | 10 |
|---|---|---|---|---|---|---|---|---|---|---|
| 1 | | | 3 | | 5 | 6 | 7 | | 9 | |
| 2 | 1 | | 3 | | 5 | | 7 | 8 | 9 | |
| 3 | 1 | | 3 | | | | 7 | | 9 | 10 |
| 4 | 1 | 2 | 3 | | 5 | | 7 | | 9 | |
| 5 | 1 | | 3 | 4 | 5 | | 7 | | | |
| 6 | 1 | | 3 | | 5 | 6 | 7 | | 9 | |
| 7 | 1 | | | | 5 | | 7 | 8 | 9 | |
| 8 | 1 | | 3 | | 5 | | 7 | | 9 | 10 |
| 9 | 1 | 2 | 3 | | 5 | | | | 9 | |
| 10 | 1 | | 3 | 4 | 5 | | 7 | | 9 | |

TEN-SHED SEMI-DUPLEX THROUGH-AIR DRYER FABRIC

FIELD OF THE INVENTION

The present invention concerns papermaker's fabrics which can be used to develop and augment caliper and bulk in paper products formed thereon. It is particularly concerned with such fabrics that are designed and arranged to provide a plurality of machine direction oriented pockets on their paper conveying surface into which the paper product is deflected as it is conveyed through a through-air drying (TAD) unit in a tissue manufacturing process. It is more particularly concerned with such fabrics which are woven according to a 10-shed, semi-duplex design which provides for pockets of two differing sizes in the paper side surface of the fabric.

BACKGROUND

In a conventional tissue forming process, a headbox directs a dilute slurry of papermaking fibers and water (known as the "stock") onto a moving forming fabric from which it is subsequently transferred downstream as a very wet web onto a though-air dryer (TAD) fabric. The web together with the fabric, pass through a through-air dryer arrangement where the web is molded and dried. In order to create bulk and other desirable tactile properties in this embryonic web, the TAD fabric will ideally impart a surface topography to the eventual sheet which topography can be provided by a combination of recesses, or pockets in the otherwise generally planar PS fabric surface of the fabric, and protrusions, or knuckles, which extend above the fabric plane. The pockets create areas of high fiber concentration in the sheet, while the protrusions form regions of relatively lower fiber concentration; together, the zones of high and low fiber concentration impart desirable softness and absorbency characteristics to the sheet thus formed. Such fabrics are well known and numerous constructions have been described in the prior art. The known fabrics are of either single or multiple layer construction, and are designed to impart a pattern onto the paper sheet which they convey so as to create the aforementioned desirable properties. These known fabrics deliver surface topography using various means, such as by providing a patterned, resin coated surface onto a woven substrate in the manner described for example by Trokhan et al. in U.S. Pat. No. 5,275,700 and others; introducing surface sculpting yarns into the fabric surface as described by Chiu et al. U.S. Pat. No. 5,429,686 or Wendt et al. U.S. Pat. No. 5,627,248; weaving the fabric according to lattice type weave patterns such as described by Hay et al. U.S. Pat. No. 6,237,644; utilizing differing yarn sizes in the PS surface of the fabric as disclosed by Lafond et al. U.S. Pat. No. 7,300,554; other means are known and used.

It is known from Quigley U.S. Pat. No. 7,993,493 ("the '493 patent") to provide a single layer TAD or forming fabric which is woven according to a 10-shed pattern to provide a plurality of pockets in the paper conveying surface of the fabric. The weave pattern forms pockets on the PS of the fabric, which pockets are defined by:

a) Two sides formed by single warp yarn knuckles each of which passes over at least 3 consecutive weft yarns;
b) The remaining two sides formed by single weft yarn knuckles each of which pass over two consecutive warp yarns;
c) A pattern square including 10 warp and weft yarns, and 10 pockets (each of which may be formed above each warp yarn in the pattern square).

In other embodiments, the '493 patent also discloses that each warp yarn knuckle may pass over 6 consecutive weft yarns, three of which define one of the 4 sides of a first pocket, the remaining three forming one of the four sides of a second pocket. Each weft yarn knuckle may pass under one of the warp yarn knuckle borders and over the other warp yarn knuckle border. Other variations are described. Fabrics woven according to the '493 patent are of single layer construction (i.e. there is one set of warp yarns which are mutually coplanar), and exhibit longitudinally oriented pockets whose bottoms are formed by a single warp yarn and two weft yarns resulting in the pocket bottom being raised in a T-shape.

While fabrics produced in accordance with the teachings of the '493 patent have met with some success, there still exists a need for a TAD fabric in which pockets having at least two differing sizes are created such that the tissue sheet formed thereon exhibits protrusions of at least two differing sizes and shapes. Such sheets may provide enhanced tactile softness as well as other physical and mechanical properties as would be desirable by the consumer.

SUMMARY

The present invention provides a woven, single layer, through-air dryer (TAD) fabric, which fabric is woven according to a repeat pattern to provide a fabric having first and second opposing and generally planar surfaces, a machine direction and a cross-machine direction which directions are mutually perpendicular and coplanar with the first and second surfaces, wherein in the pattern repeat, warp and weft yarns are interwoven to provide a plurality of warp and weft yarn knuckles which together comprise the generally planar fabric surfaces and, between two adjacent pairs of warp and weft yarn knuckles on at least a first fabric surface, pockets having an area that is defined by the pairs of warp yarn knuckles and weft yarn knuckles and a depth which is recessed below the first planar surface, wherein in each repeat of the pattern:

- the pockets are comprised of first pockets having a first area exposed on the first fabric surface and second pockets having a second area exposed on the first fabric surface;
- the bottom surface of each pocket is defined by a warp yarn and at least one weft yarn and is recessed below the generally planar first fabric surface;
- the perimeter of each first and second pocket is defined by two warp yarn knuckles and two weft yarn knuckles;
- each warp yarn knuckle is separated in the cross-machine direction from an adjacent warp yarn knuckle by one warp yarn which forms knuckles on the second fabric surface;
- the number of first pockets in the repeat pattern is equal to the number of second pockets;
- the open area defined by the perimeter of the first pockets is different from the open area defined by the perimeter of the second pockets; the first pockets and the second pockets are both arranged in a diagonal twill pattern on the first fabric surface;
- the two warp yarn knuckles and two weft yarn knuckles defining the perimeters of each of the first and second pockets are arranged such that:
  - a. the warp yarn knuckles float over from 4 to 9 weft yarns;
  - b. the weft yarn knuckles float over 3 warp yarns;
  - c. each warp yarn knuckle defines the machine direction (MD) sides of two first pockets and two second pockets; and
  - d. each weft yarn knuckle defines the cross-machine direction (CD) sides of two first pockets and two second pockets.

In one embodiment, the weave is a 10 shed pattern requiring 10 warp yarns and 10 weft yarns in each repeat.

Preferably, the fabric is symmetrical such that the repeating pattern provided to the first and second generally planar surfaces is identical. Alternatively, the repeating pattern provided to each of the first and second planar surfaces is not identical and the fabric is not symmetrical.

Preferably, within one repeat of the weave pattern in the fabric, alternate (i.e. every second) warp yarns appear predominantly on only one of the two generally planar fabric surfaces. More preferably, alternate warp yarns are arranged so as to provide warp yarn knuckles to one of the two fabric surfaces.

Preferably, the weave provides a semi-duplex construction wherein the warp yarns form two apparent planes in the fabric and the warp yarns are not stacked in vertical relation one over the other.

Preferably, the warp yarn knuckles float over at least 4 weft yarns on a first of the two fabric surfaces. Alternatively, the warp yarn knuckles float over up to 9 weft yarns.

Preferably, each of the warp yarn knuckles forms the MD sides of four pockets. More preferably, the warp yarn knuckles form the MD sides of two first pockets and two second pockets which are mutually adjacent to one another.

Preferably, the first and second pockets are separated in the MD by one weft yarn knuckle.

Preferably, the weft yarn knuckles float over three warp yarns on one of the two fabric surfaces.

Preferably, each pocket is separated in the CD from the adjacent pocket by one warp yarn. Each pocket is preferably separated in the MD from the adjacent pocket by one weft yarn. More preferably, each pocket is separated from an adjacent pocket by one warp and one weft yarn knuckle.

In the fabrics of the invention, each pocket is defined by two warp yarn knuckles and two weft yarn knuckles. Each warp yarn knuckle is separated in the CD from an adjacent warp yarn knuckle on the same fabric surface by one warp yarn.

Also in the fabrics of the invention, the warp yarns are arranged so as to form knuckles on at least one of the two fabric surfaces; in one preferred design (e.g. FIG. 1) 50% of the warp yarns float over 8 weft yarns in one repeat of the weave pattern so as to form two warp yarn knuckles on one of the two fabric surfaces, each knuckle of which floats over 4 consecutive weft yarns. In another preferred design, (e.g. FIG. 6) the warp yarns float over 9 consecutive weft yarns in one repeat of the weave pattern so as to form one warp yarn knuckle on one of the fabric surfaces. Other designs with different warp knuckle float lengths are possible. In both preferred embodiments, only 50% of the warp yarns in one repeat of the weave pattern form knuckles on one surface of the fabric.

In another aspect, the invention provides a single layer fabric woven from a system of warp yarns and a system of weft yarns to define first and second generally planar surfaces corresponding to a paper support surface and a machine side surface. The warp and weft yarns are interwoven to provide a plurality of warp and weft yarn knuckles forming the first generally planar fabric surface, and pockets are defined between two adjacent pairs of warp and weft yarn knuckles on each of the first and second generally planar surfaces. The pockets having an area that is defined by the pairs of warp and weft yarn knuckles and a depth which is recessed below the first planar surface. The warp yarn knuckles of a first group of warp yarns consisting of alternate ones of the warp yarns form sides of the pockets on the paper support surface of the fabric and form bottoms of the pockets on a machine side surface of the fabric. The warp yarn knuckles of a second group of warp yarns consisting of the remaining warp yarns that are not in the first group form pocket sides on the machine side surface and form bottoms of the pockets on the paper support surface. The warp yarn knuckles that form the sides of the pockets float over from 4 to 9 weft yarns, and the weft yarn knuckles that form remaining sides of the pockets float over 3 warp yarns on each of the paper support and machine side surfaces.

In a preferred embodiment, each of the fabric surfaces includes pockets of two different sizes.

Preferably, each of the warp yarn knuckles forms the sides of 4 pockets. Each of the weft yarn knuckles preferably also forms the sides of 4 pockets. More preferably, the pockets on each surface of the fabric are separated from adjacent pockets by a single yarn in each direction.

In another aspect, opposite corners of each of the pockets are formed by the warp yarn knuckles, and other opposite corners formed by the weft yarn knuckles In all embodiments of the invention, the warp and weft yarn knuckles together define at least the first planar surface of the fabrics. The pockets formed between the knuckles have a surface area whose perimeter is defined by two warp and two weft yarn knuckles. The bottom surface area of each pocket is defined by one warp yarn and at least one weft yarn, both of which are recessed below the first planar surface. Each pocket has a pocket depth that is between 50% and 100% of the diameter, or thickness, of the warp yarns.

The fabric may be woven using either circular cross-section monofilaments or flat (rectangular cross-section) warp yarns whose aspect ratio (ratio of width to height) is 1.4:1 or greater. If circular cross-section yarns are used, the fabric may require a mechanical surface treatment such as by abrasion (sanding) to provide a desired contact area of at least about 14%, and preferably at least 20%, or more. Alternatively, generally rectangular monofilaments may be used, in which case fabric surfacing (e.g. by abrasion) may not be necessary, or is at least significantly reduced. However, these fabrics are typically sanded to increase contact area between fabric and sheet and thus improve various properties relating to sheet transport in a TAD process, or sheet release in the forming process.

The weft yarns used in the fabrics of the invention may be of circular or generally rectangular cross-sectional shape; circular is preferred. The diameter of the circular weft yarns will be in the range of from about 0.30 mm to about 0.80 mm. Selection of appropriate weft yarn diameter will be dictated by the end use requirements of the fabric as they will have a significant effect on certain of the performance characteristics of the fabric, such as air permeability.

The component monofilaments are ideally comprised of a polyester such as PET which has been stabilized to retard hydrolytic degradation due to the heat and humidity encountered in the sheet product process; alternatively, the yarns are comprised of a polymer such as PPS, PEEK or the like which are inherently resistant to such degradation. The fabric may be coated with a surface treatment prior to or during use with a nanoparticle coating such as described in U.S. Pat. No. 7,811,627 to Baker et al.

Following weaving, the fabric is heat-set according to known techniques so as to structurally stabilize it against deformation. A suitable seam is then installed in the resulting fabric; the seam is typically a woven-in seam in which a portion of the weft yarns are removed adjacent the fabric ends, the warp ends are freed at these locations, and the free warp yarns are then rewoven back into the corresponding opposing paths according to techniques known in the art. The thus formed seam may be reinforced by laser welding, ultrasonic bonding, or application of a suitable adhesive at or proximate to the warp terminations. Alternatively, a pin seam or other suitable seam construction may be installed, depending on need. The completed fabric is then ready for installation in either the forming or through-air dryer section of a papermaking machine.

BRIEF DESCRIPTION OF THE DRAWING(S)

The foregoing Summary as well as the Detailed Description that follows of the preferred embodiments of the invention will be better understood when read in conjunction with the appended drawings. In the drawings.

Figure 9A:
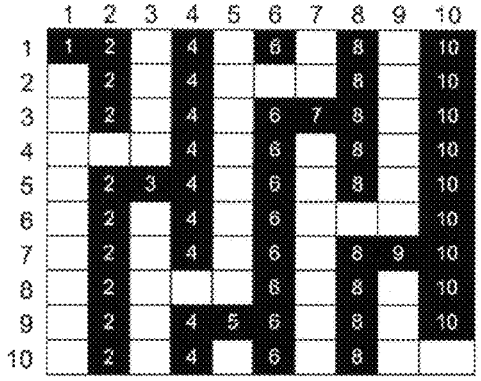
Figure 9B:
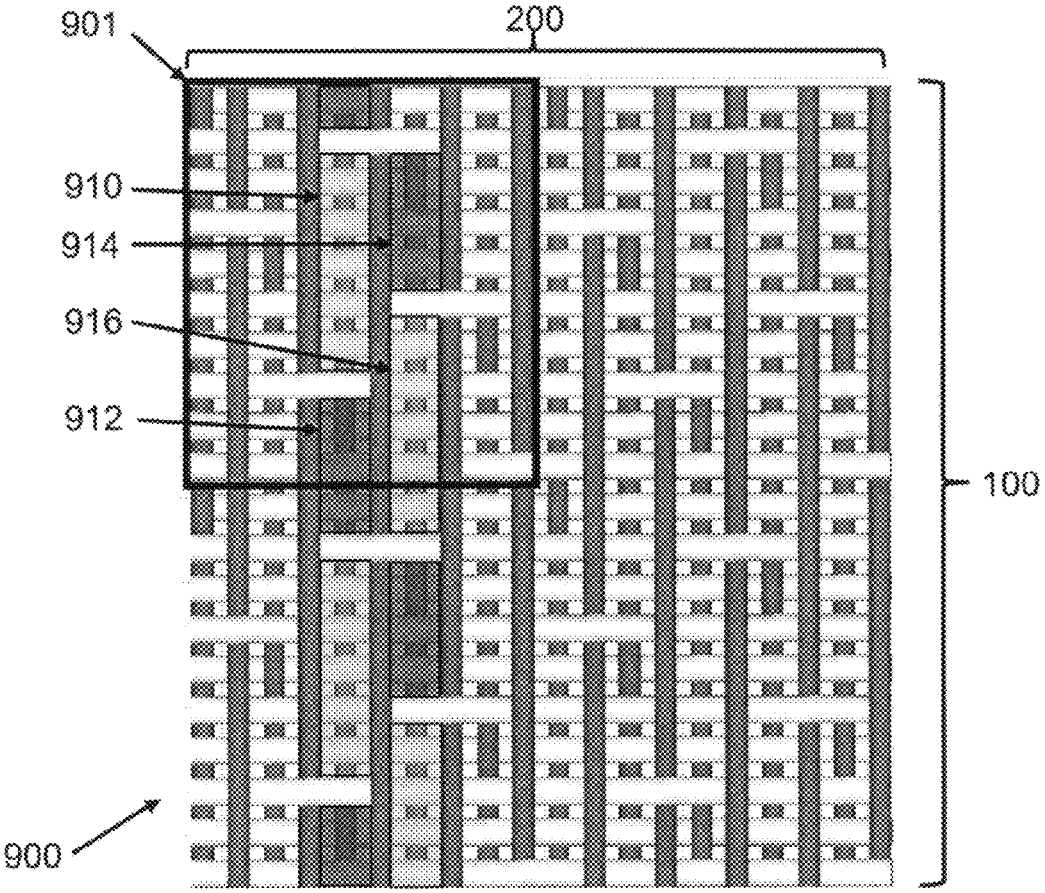

FIG. 9*a* is a weave diagram of a 10-shed, single layer semi-duplex TAD fabric according to a third embodiment of the invention;

FIG. 9*b* is a planar view of the PS surface of a representation of a fabric woven according to the weave diagram presented in FIG. 9*a;*

Figure 9C:
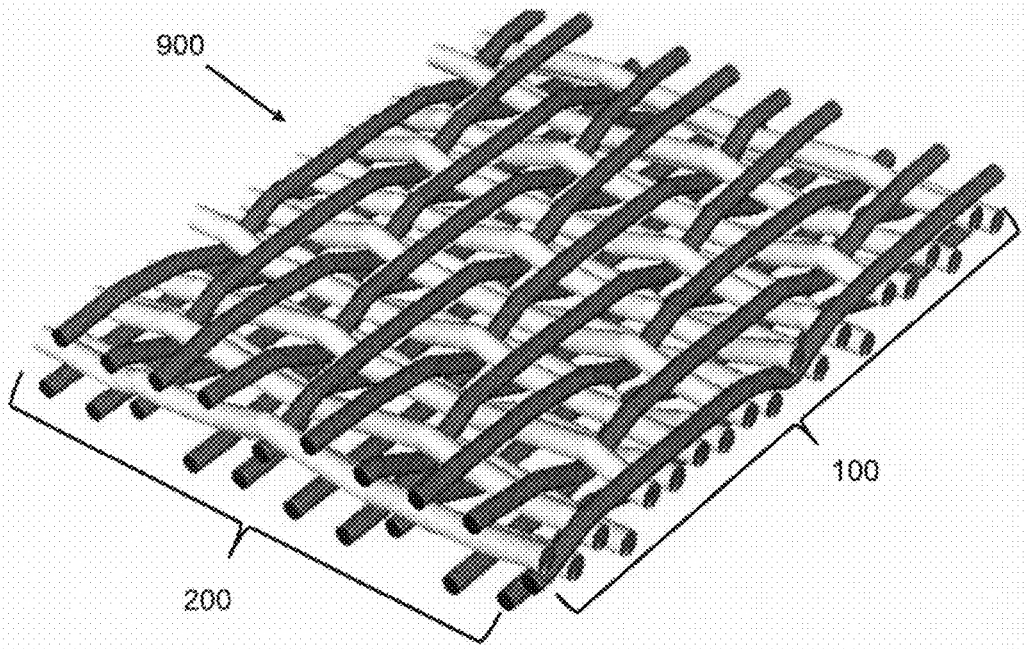

FIG. 9*c* is a perspective view of a representation of the fabric presented in FIG. 9*b;*

Figure 10A:
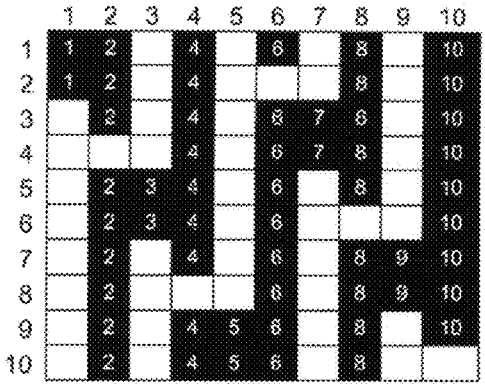
Figure 10B:
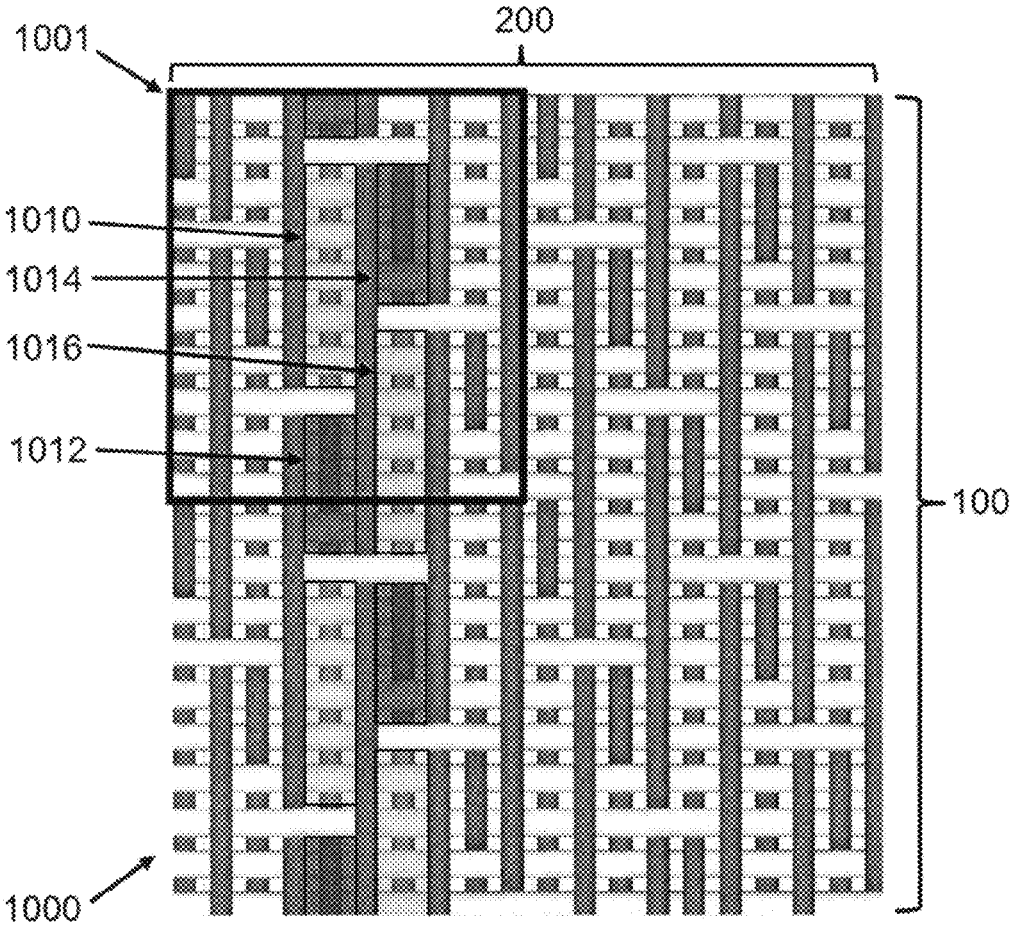

FIG. 10*a* is a weave diagram of a 10-shed, single layer TAD fabric according to a fourth embodiment of the invention;

FIG. 10*b* is a planar view of the PS surface of a representation of a fabric woven according to the weave diagram presented in FIG. 10*a;*

Figure 10C:
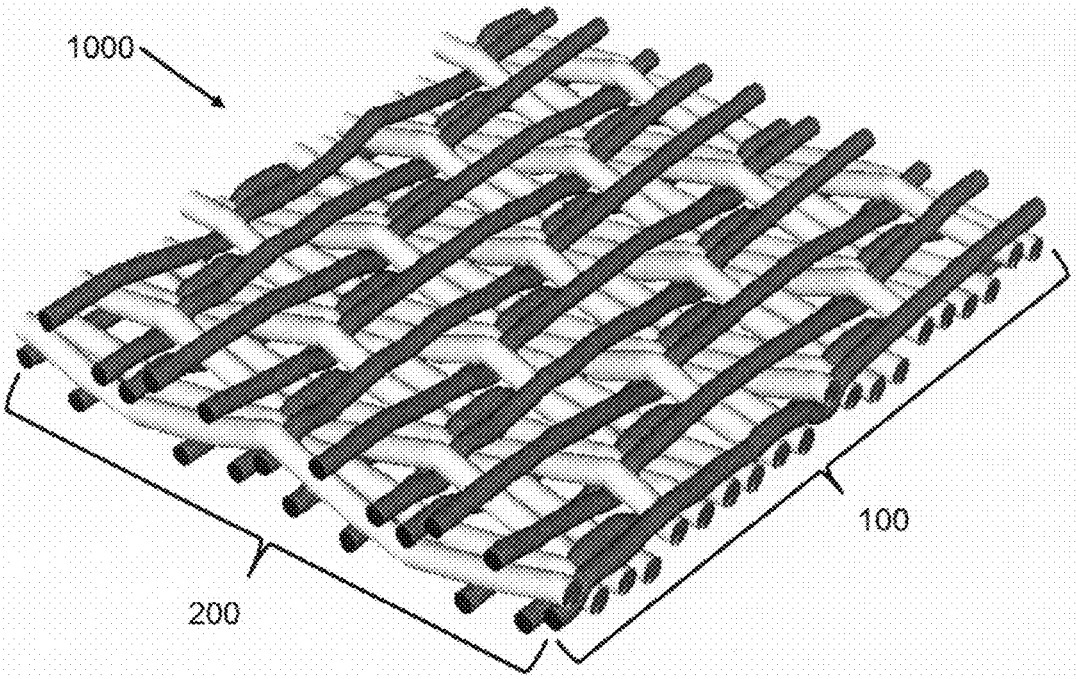

FIG. 10*c* is a perspective view of a representation of the fabric presented in FIG. 10*b;*

Figure 11A:
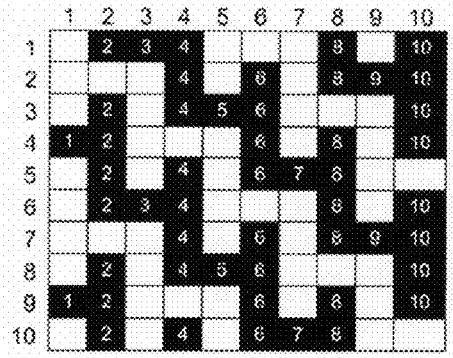
Figure 11B:
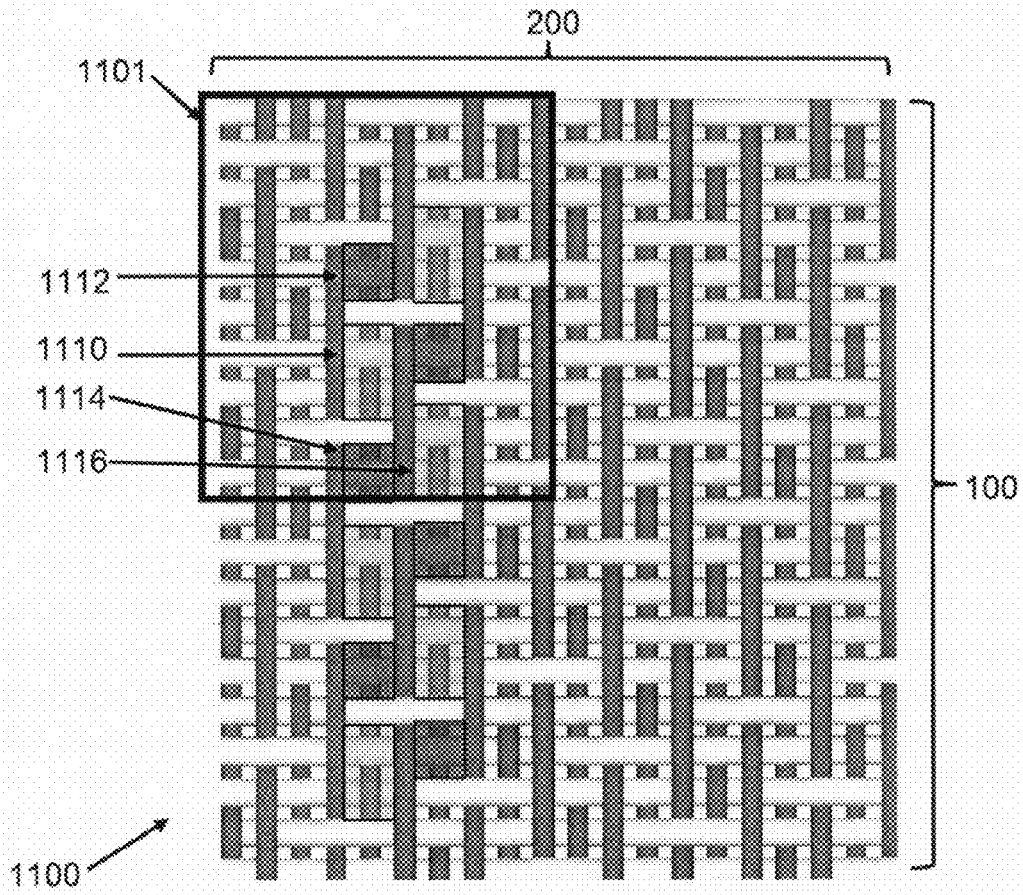

FIG. 11*a* is a weave diagram of a 10-shed, single layer TAD fabric according to a fifth embodiment of the invention;

FIG. 11*b* is a planar view of the PS surface of a representation of a fabric woven according to the weave diagram presented in FIG. 11*a;*

Figure 11C:
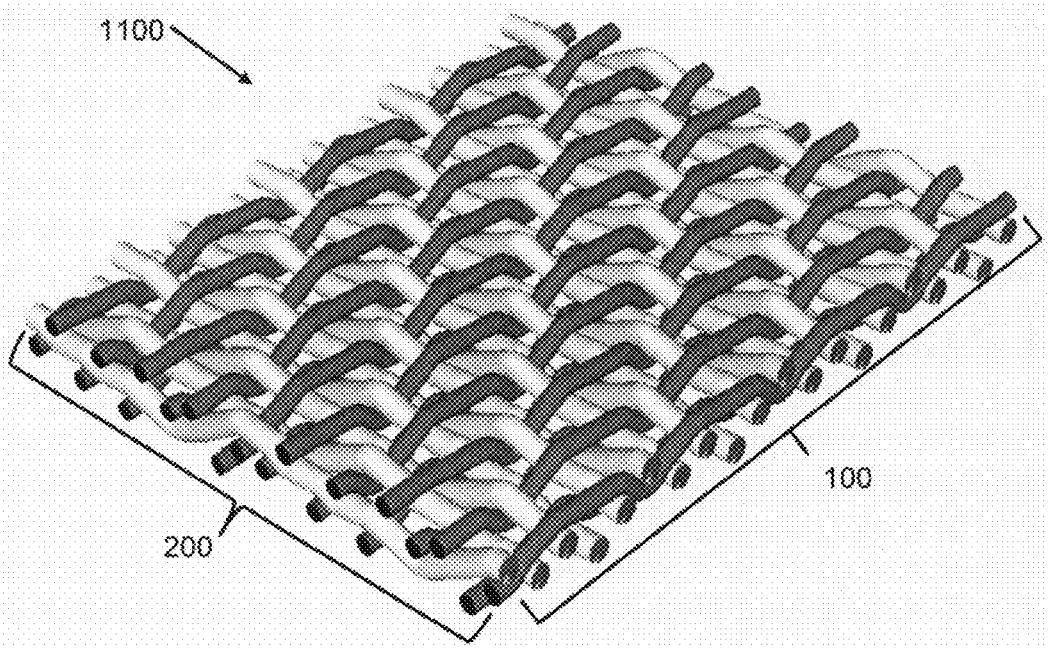

FIG. 11*c* is a perspective view of a representation of the fabric presented in FIG. 11*b;*

Figures 12A, 12B:
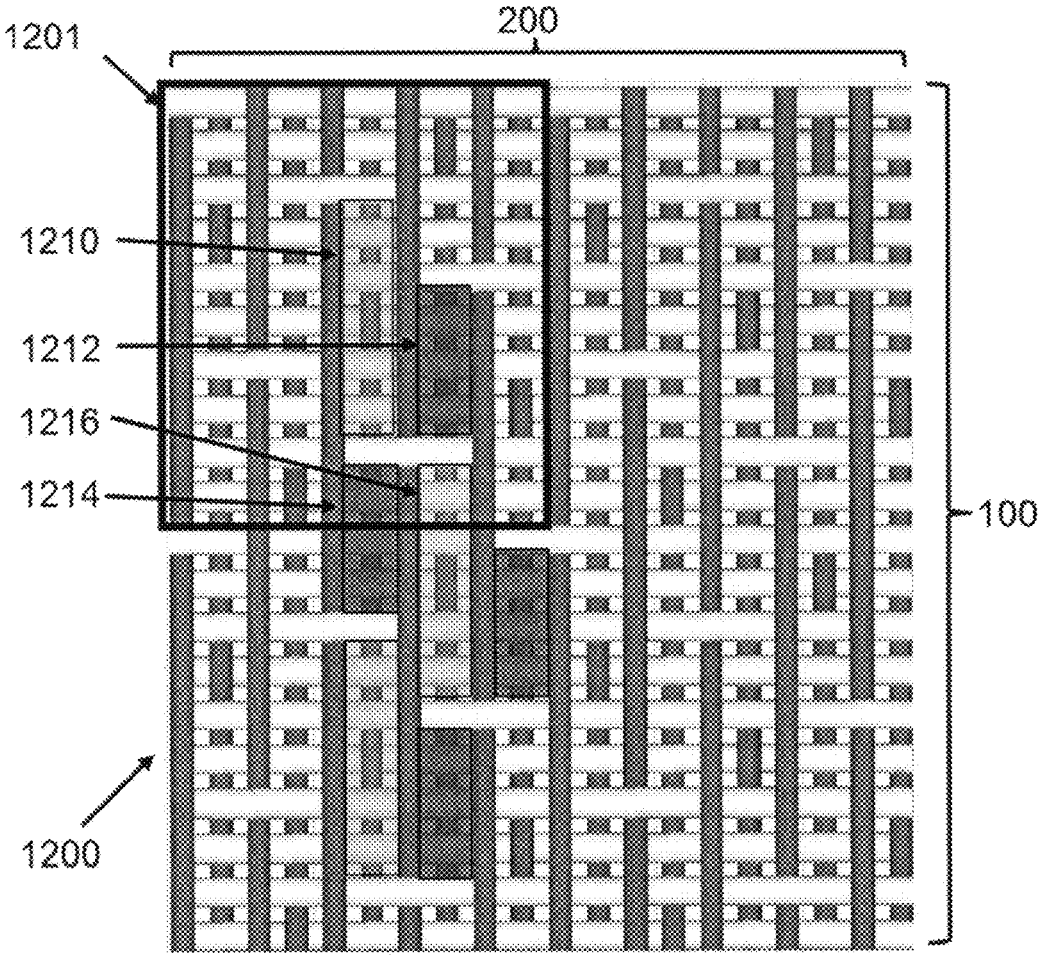

FIG. 12*a* is a weave diagram of a 10-shed, single layer TAD fabric according to a sixth embodiment of the invention;

FIG. 12*b* is a planar view of a representation of the PS surface of a fabric woven according to the weave diagram presented in FIG. 12*a;*

Figure 12C:
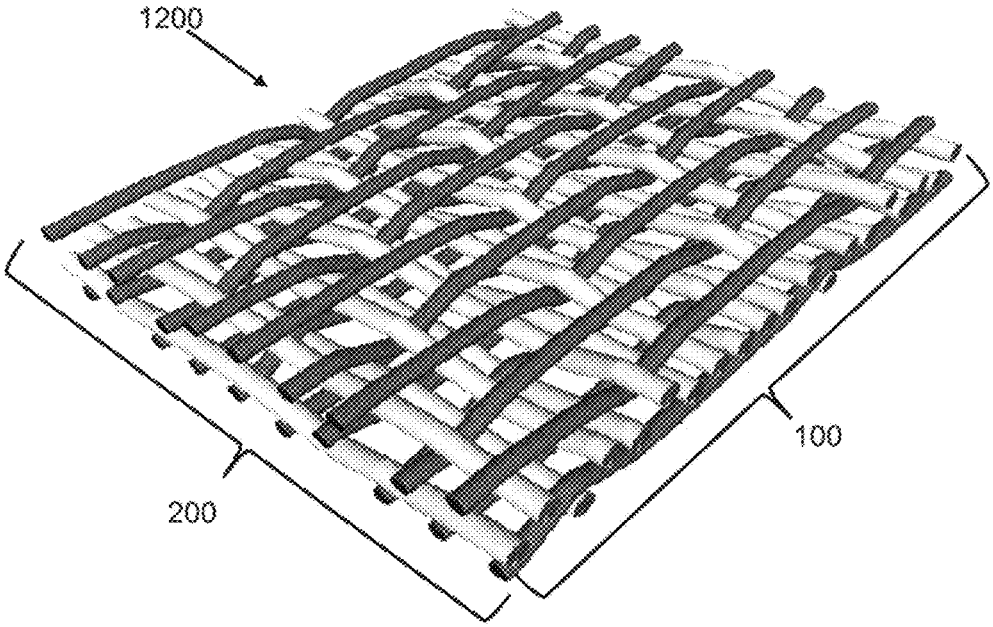

FIG. 12*c* is a perspective view of the fabric representation presented in FIG. 12*b;*

Figures 13A, 13B:
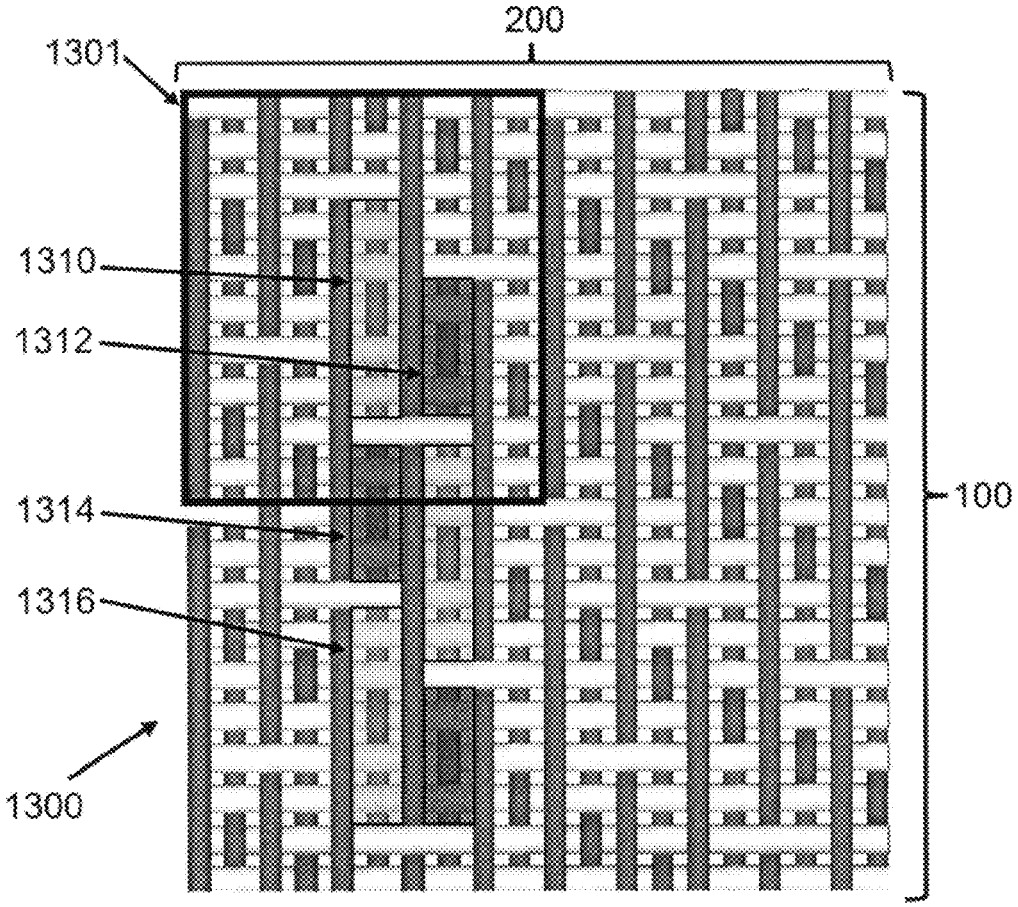
Figure 13C:
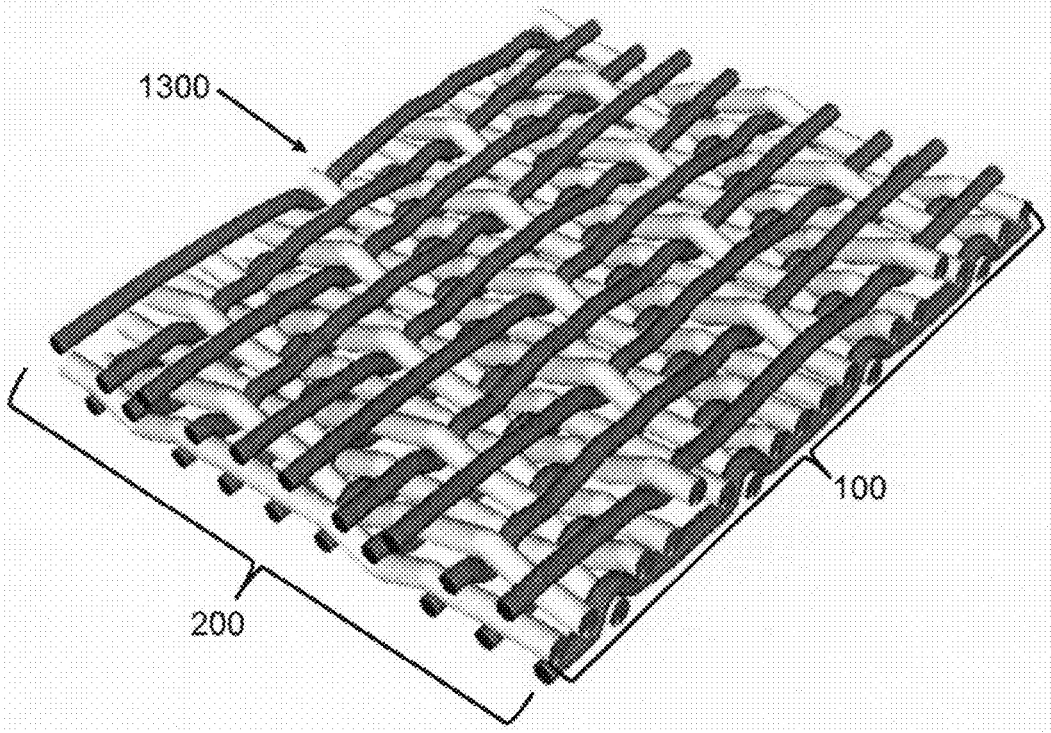

FIG. 13*a* is a weave diagram of a 10-shed, single layer TAD fabric according to a seventh embodiment of the invention;

FIG. 13*b* is a planar view of a representation of the PS surface of a fabric woven according to the weave diagram presented in FIG. 13*a*; and FIG. 13*c* is an isometric view of the fabric representation presented in FIG. 13*b*.

DETAILED DESCRIPTION OF THE PREFERRED EMBODIMENT(S)

Certain terminology is used in the following description for convenience only and is not considered limiting. As used herein, the terms "up", "down", "top", "bottom", "left" and "right" have the meanings normally attributed to them when used with reference to the accompanying drawings. The term "machine direction", or MD, refers to a direction in the papermaking machine that is from the headbox towards the dryer section; the term "cross-machine direction", or CD, is a direction that is perpendicular to and coplanar with the MD. In the fabrics of the invention, the warp yarns are normally oriented generally in the MD, while the weft yarns are normally oriented in the CD when the fabric is in use. The woven fabric has two coplanar surfaces: one is the machine side (MS) which is that surface which, when in use, will be in contact with rolls and stationary elements in the machine for which it is intended; the second is the paper side (PS) upon which the product will be formed and conveyed. Additionally, the terms "a" and "one" are defined as including one or more of the referenced item unless specifically noted.

In the fabrics of this invention, the warp and weft yarn knuckles define the exterior boundary of at least one of these surfaces, in particular the PS. A warp or weft yarn "knuckle" is a localized deformation caused by a first yarn bending over or around one or more second yarns oriented perpendicularly to and interwoven with the first so as to "float" over and be supported by the second yarns. The related term "float length" refers to the number of second yarns over which a selected first yarn floats. Thus, a "knuckle" is a portion of a yarn which, in the woven fabric, is raised a small amount above the general fabric plane as it floats over certain other yarns and defines at least the first planar surface of the fabric, while a "pocket" is an area in the first planar surface whose perimeter is defined by two warp and two weft yarn knuckles and whose interior surface is recessed below the exterior boundary of the PS. The "open area" of a pocket is therefore the length×the width of the pocket. When in use, the pockets in the fabric surface create small, localized "pillows" of relatively higher fiber density in the thus formed sheet; the warp and weft yarn knuckles of the fabric surface are localized protrusions above the general fabric plane which produce areas of relatively lower fiber density in the product. Together, the knuckles and pockets in the fabric surface impart bulk and other important mechanical properties to the paper sheet to enhance its utility for use as a tissue or towel product.

Figure 1:
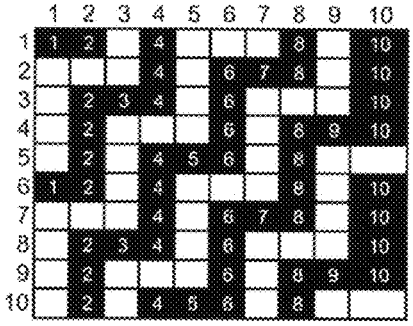
FIG. 1 is a weave diagram of a 10-shed, single layer TAD fabric according to a first embodiment of the invention.

FIG. 1 is a weave diagram of a unit cell or pattern square of a first embodiment of a fabric that is woven in accordance with the teaching of the present invention; the weave diagram provides the weaving, or interlacing, pattern of the warp and weft yarns in one repeat of the fabric weave. In the weave diagram, the warp yarns are numbered from 1 to 10 across the top of the diagram, while the weft yarns are numbered from 1 to 10 along the left side. In accordance with convention for such diagrams, a black square indicates that a warp yarn is above a weft yarn, while a white square indicates that the warp yarn is below a weft yarn at the selected location. It will be apparent to those of skill in the art that the unit cell of FIG. 1 represents one repeat of the weave pattern which is duplicated across the width and the length of the entire fabric. The weave pattern requires 10 sheds in the loom to control the position of the warp yarns, and the pattern repeats over 10 weft, such that an eleventh ($11^{th}$) weft yarn will follow the same interlacing pattern as that shown for weft number 1 at the top of the diagram.

Examination of the weave diagram of FIG. 1 shows that, beginning at the upper left corner of the pattern, warp yarn 1 passes over weft yarn 1, under weft yarns 2, 3, 4 and 5, over weft yarn 6, and then under weft yarns 7 through 10; at this point, the path of warp yarn 1 repeats the illustrated pattern beginning from weft yarn 1. The adjacent warp yarn 2 also passes over weft yarn 1, then under weft yarn 2, over weft yarns 3 to 6, under weft yarn 7, and then over weft yarns 8 to 10 to complete the pattern.

Figure 2:
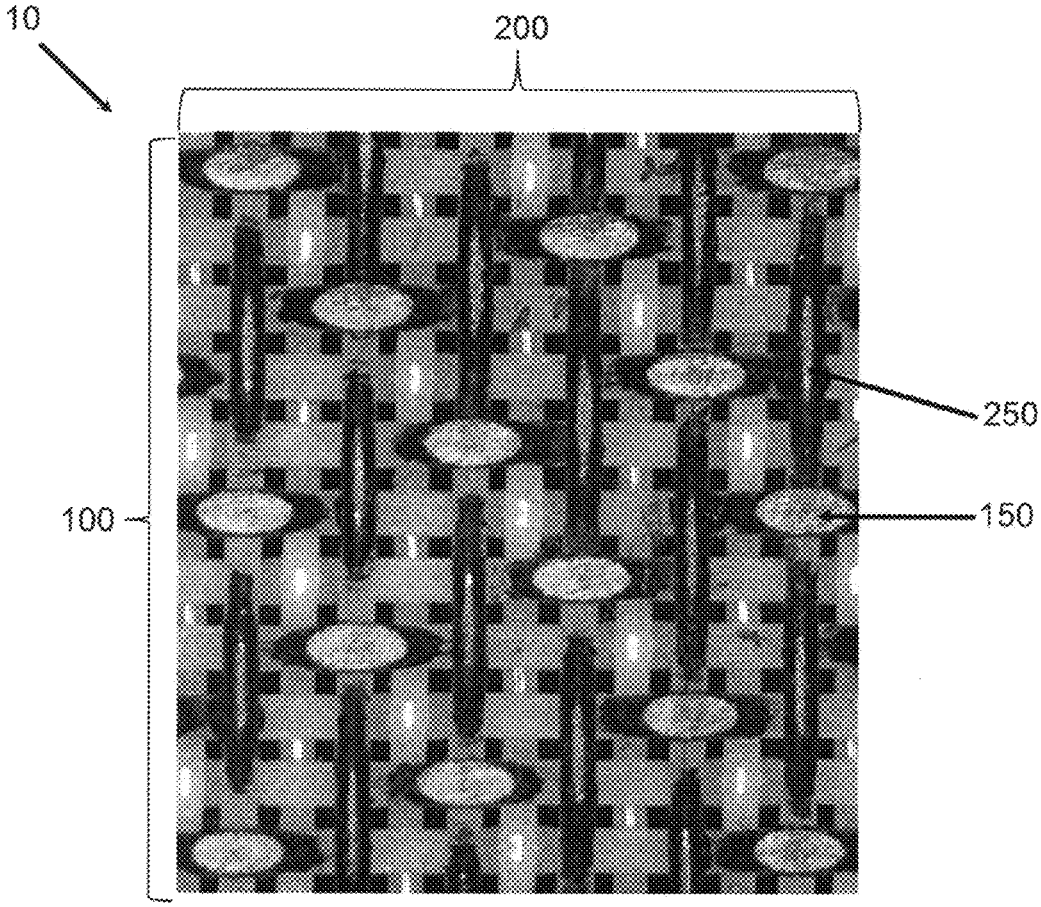
FIG. 2 is a photograph of the PS surface of a fabric woven according to the weave diagram of FIG. 1.

Warp yarns 3, 5, 7 and 9 follow similar paths to that of warp 1, but are offset relative to each other by two weft (i.e. the path of warp 1 is repeated, but commences as if shifted down in the pattern by two weft). Warp yarns 4, 6, 8 and 10 follow similar paths to that of warp 2, but are also offset, or shifted, by two weft yarns in the pattern. Because of the alternation of similar warp paths by every second warp yarn, the fabric of FIG. 1 is symmetric and, in the woven cloth, both opposing planar surfaces are essentially identical. It will also be appreciated that it is only every second warp yarn in the pattern, i.e. warp yarns 2, 4, 6, 8 and 10 which form knuckles on the PS of the fabric as it is only these warp yarns which are "up" as indicated by the black squares in the pattern. Warp yarns 1, 3, 5, 7 and 9 are passed over by the weft yarns in this pattern (as indicated by the white squares) and thus appear on the opposite MS surface of the fabric. FIG. 2 shows this arrangement more clearly.

FIG. 2 is a photograph of the PS (paper side) surface of a fabric 10 woven according to the weave pattern design shown in FIG. 1; this is the fabric surface which would, when in use, be used to convey the paper product that is to be produced using the fabric. However, because of the symmetrical nature of this fabric design, either the PS or the opposing MS (machine side) surface could be used for this purpose. In FIG. 2, the weft yarns 100 are oriented from left to right across the page, while the warp yarns 200 are oriented vertically down the page. The warp and weft yarn knuckles in the PS surface of the fabric as shown in FIG. 2 have been surfaced (mechanically abraded) so as to increase the surface contact area of the fabric, the result of which appears as ovals in the weft yarn knuckles such as at 150 and the warp yarns as at 250. Examination of the fabric surface shown in FIG. 2 in conjunction with the weave diagram of FIG. 1 shows that only every second warp yarn forms a warp yarn knuckle such as 250 in this surface (shown in black in FIG. 2). The alternate warp yarns, which are not colored, lie below the plane of the warp yarn knuckles formed by every second warp yarn and serve to form the bottom of the pockets created in the fabric surface by the weave pattern.

Figure 3:
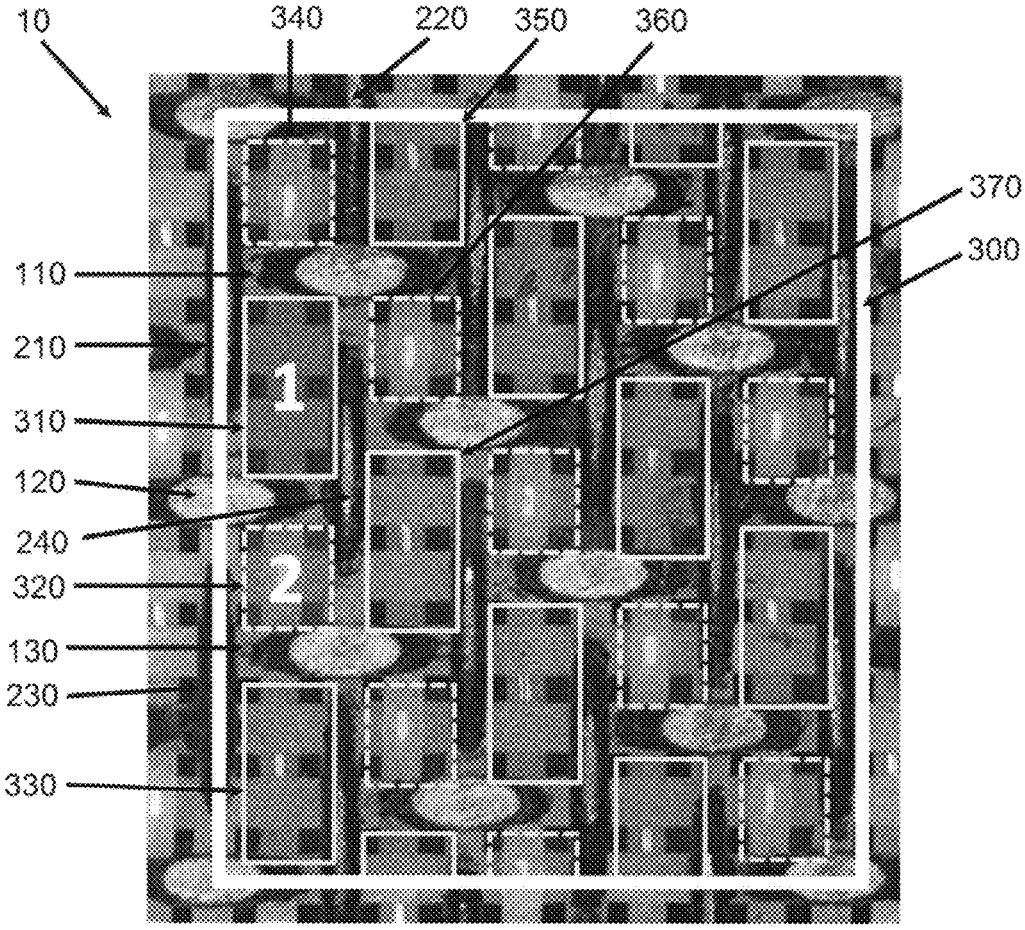
FIG. 3 is a detailed representation of the fabric shown in FIG. 2 which was woven according to the weave pattern shown diagrammatically in FIG. 1 and showing the first and second pockets as formed in the PS surface of the woven fabric.

FIG. 3 presents a photograph of the fabric 10 shown in FIG. 2 with a unit cell 300 superimposed on the PS surface of the fabric to clearly indicate one full repeat of the weave pattern (i.e. the weave diagram of FIG. 1). FIG. 3 also shows in outline the fabric pockets provided by the weave pattern in one unit cell or repeat. Inspection of FIG. 3 shows that there are 20 pockets in the unit cell 300; the pockets are of two differing sizes and each is outlined on the fabric surface using a solid line for the larger pockets (denoted by the numeral 1 inside a representative large pocket area 310) and a dashed line for the smaller pockets (denoted by the corresponding numeral 2 inside representative smaller pocket 320). The first pockets, such as at 310, 330, 350 and 370 are "larger" pockets, meaning they have a larger open surface area than the second pockets, such as at 320, 340 and 360 which are smaller in relation to the first pockets. There are 10 large first pockets and 10 small second pockets in the unit cell 300 shown in FIG. 3.

Inspection of a larger pocket such as 310 shows that it is bordered by two warp yarn knuckles 210 and 240, and two weft yarn knuckles 110 and 120. The warp yarn knuckles 210 and 240 each "float", or pass over, four consecutive weft yarns on each MD side of the pocket 310. Warp yarn knuckle 240 is "bounded" at the upper end of pocket 310 by the knuckle formed by weft 110, and at the lower end by the knuckle formed by weft 130. It can also be seen that warp yarn knuckle 240 forms a common MD border for both large pocket 310 and adjacent small pocket 320, as well as small pocket 360 and large pocket 370. The knuckle formed by weft 110 forms the top boundary of large pocket 310 where it floats over three warp in succession from left to right, while also forming the top boundary of the adjacent (right) small pocket 360. It can also be seen that weft yarn knuckle 110 also forms the bottom perimeter of small pocket 340 and large pocket 350.

As shown in FIG. 3, small pocket 320 is bounded on top by weft yarn knuckle 120, which also forms the bottom perimeter of large pocket 310; weft yarn knuckle 130 forms the bottom boundary of small pocket 320 and adjacent large pocket 370; warp yarn knuckles 230 and 240 form the left and right sides respectively of small pocket 320. Warp yarn knuckle 230 also forms the left boundary of large pocket 330 which is bounded by weft knuckle 130 at the top; the pattern continues in the manner just described throughout the fabric.

FIG. 3 thus shows a fabric woven according to the 10-shed pattern of FIG. 1 which provides for 20 pockets of two differing sizes in each unit cell measuring 10 warp by 10 weft in a fabric of the invention. Each pocket is bounded by warp yarn knuckles which float over 4 weft yarns to form lateral MD sides of both the large pockets such as 310 and small pockets such as 320. Each pocket is also bounded by weft yarn knuckles of two weft yarns each of which forms a float as they pass over three warp yarns. Comparison of FIG. 3 with the weave pattern of FIG. 1 clearly shows this float pattern. The interior open areas of the large pockets such as 310 each include 2 weft yarns and one warp yarn; the interior open areas of small pockets such as 320 are formed by one warp yarn and one weft yarn. The large pockets such as 310 thus have a length of two weft and width of one warp yarn; the small pockets such as 320 have a length and width of one weft and warp yarn. Thus, it can be seen that each of the first and second pockets is bounded by two warp yarn knuckles and two weft yarn knuckles which are arranged such that:

a) the warp yarn knuckles float over 4 weft yarns;

b) the weft yarn knuckles float over 3 warp yarns;

c) each warp yarn knuckle defines MD sides of four adjacent pockets, two of which are first pockets having a first size, and the remaining two of which are second pockets having a second size;

d) each weft yarn knuckle defines CD sides of four adjacent pockets, two of which are first pockets having a first size, and the remaining two of which are second pockets having a second size; and e) the first size is not equal to the second size.

Figure 4:
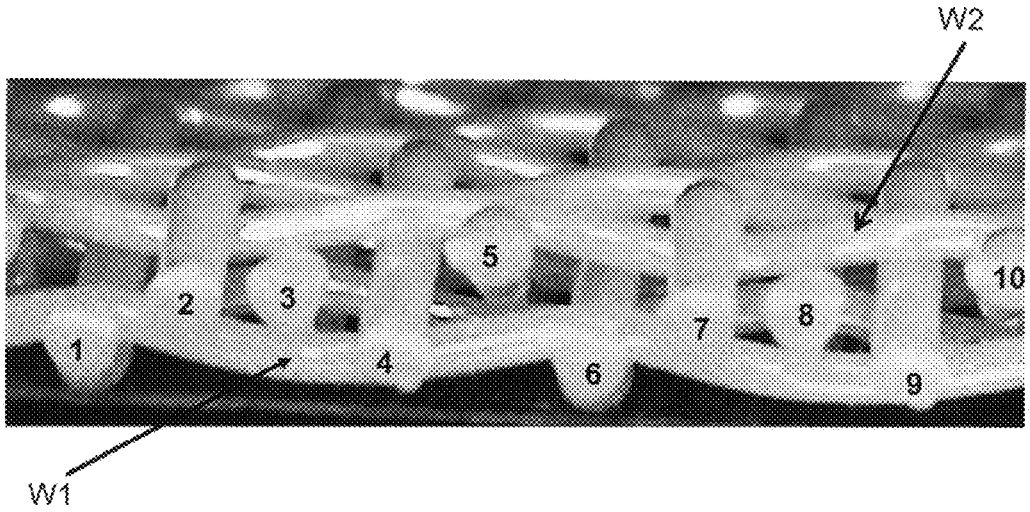
FIG. 4 is a photograph of a cross-section of the fabric shown in FIG. 2 taken along the warp (MD) yarns.

FIG. 4 shows, in cross section across the weft yarns and along a warp yarn, one full repeat of the weave pattern shown in FIG. 1. In FIG. 4, the paths of warp yarns 1 and 2 from the pattern of FIG. 1 is shown. As can be seen from left to right in FIG. 4, warp yarn 1 (indicated as W1) passes over weft yarn 1, under weft yarns 2 through 5 (forming a MS warp yarn knuckle), over weft yarn 6 and then under weft yarns 7 to 10 (forming another MS warp yarn knuckle) to complete the repeat. Adjacent warp yarn 2 (indicated as W2) passes over weft yarn 1, under weft 2, and then over wefts 3, 4, 5 and 6 to form a PS warp yarn knuckle or float of length four. Warp yarn 2 then passes under weft yarn 7 and over weft yarns 8, 9, 10 and 1 to form a second PS warp yarn knuckle or float over four weft yarns. Inspection of FIG. 4 shows that the warp float length on each of the PS and MS surfaces of the fabric is the same and is over four weft yarns.

Figure 5:
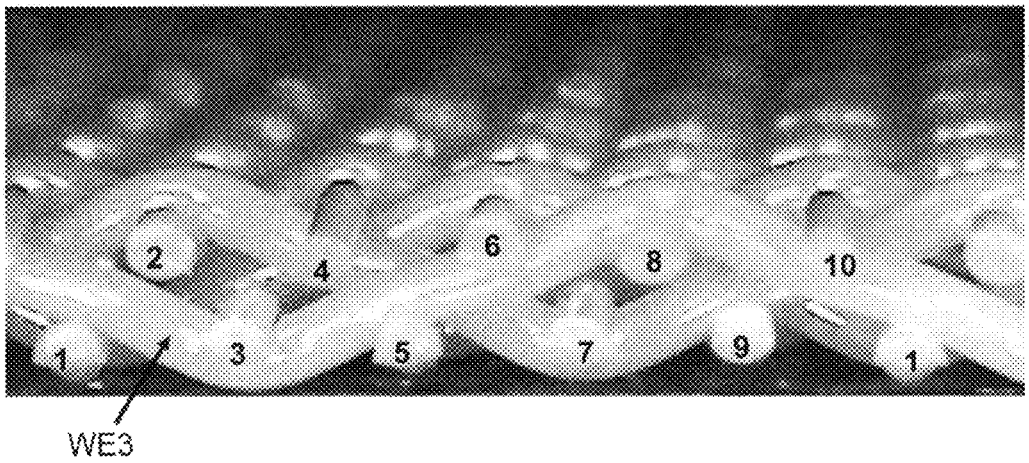
FIG. 5 is a photograph of a cross-section of the fabric shown in FIG. 2 taken along the weft (CD) yarns.

FIG. 5 is a photograph showing a cross-section of the fabric presented in FIG. 4, but taken along a typical weft yarn such as weft 3 (or 8) (indicated as WE3) in the pattern shown in FIG. 1, which traverses across the fabric as it is interwoven with the warp yarns. In FIG. 5, the warp yarns are numbered as shown in FIG. 1. From left to right are shown warp yarns 1 through 10; the pattern re-starts at warp 1 at the right of the photograph; the path of weft yarn 3 (which is the same as weft yarn 8) from the pattern in FIG. 1 is shown. In accordance with that pattern, weft yarn 3 passes over warp 1, then under warps 2, 3 and 4 (forming a MS weft yarn knuckle), over 5, under 6, then over warps 7, 8 and 9 and under 10 (forming a PS weft yarn knuckle), at which point the weft pattern repeats as it passes over warp 1. Comparing FIG. 1 with FIG. 5, it can be seen that weft 3 forms a knuckle between warps 6 and 10 where it floats over warps 7, 8 and 9; this float (shown in planar view for example in FIG. 3 as 120) forms the lateral end of both a large pocket (such as 310 in FIG. 3) and a small pocket (such as 320 in FIG. 3). It can also be seen from inspection of FIGS. 1 and 5 that the weft yarn pattern repeats itself after every five weft yarns (so the path of weft 1 is the same as weft 6, weft 2 is the same as weft 7, and so on).

It can also be seen from FIG. 5 that the warp yarns 1 through 10 are arranged in two separate planes as a consequence of their interweaving with the weft yarns according to the selected semi-duplex weave pattern, so that warps 2, 4, 6, 8 and 10 are preferentially located towards a first surface of the fabric shown in FIG. 5, and warps 1, 3, 5, 7 and 9 are located on the second surface of the fabric. This arrangement is characteristic of fabric constructions known as "semi-duplex single layer", which are essentially single layer fabrics woven with one system of warp yarns and two weft yarn systems. In the fabrics of the present invention, there is only one set of warp and one set of weft yarns; however, the weave patterns used in these fabrics causes one half of the warp yarns to be located predominantly onto one surface and the other half of the warp onto the opposite fabric surface, in the same manner as would occur in a traditional semi-duplex fabric. Thus, the fabrics of the invention can be said to exhibit a semi-duplex appearance and are of a single layer construction. A benefit provided by this construction is the formation of relatively "deeper" pockets in the PS surface, which pocket depth can range from between 50% and 100% of the warp yarn diameter or thickness.

If the fabrics of the invention are woven using circular cross-section polymeric monofilaments, the diameter of the warp yarns will generally be in the range of from about 0.20 mm to about 0.50 mm; preferably, the warp yarn diameter is in the range of about 0.25 mm to about 0.40 mm, with a yarn diameter of from about 0.27 mm to about 0.35 mm being most preferred depending upon various fabric requirements. If woven from generally rectangular monofilaments, the warp yarn width will generally be in the same range as the diameters of the circular cross-section warp yarns (i.e. between 0.20 mm and 0.50 mm, with a width of from about 0.27 mm to about 0.35 mm being preferred). Those skilled in the art will appreciate that selection of an appropriate yarn size will be dictated by various requirements of the intended fabric application and the above dimensions should in no way be considered limiting.

The fabrics of the invention may be woven using a conventional industrial loom which has been threaded to provide a warp yarn density (mesh) that is typical for these fabrics and ranges from about 40 to 50 yarns/inch (15.75 yarns/cm to 19.7 yarns/cm). The weft yarn density (knock) will generally be in the range of about 30 to 60 yarns per inch of fabric length (11.8 yarns/cm to 23.6 yarns/cm). Selection of an appropriate mesh and knocking will depend on various factors, such as desired air permeability, sheet topography, and so on.

The open areas of the large and small pockets are defined and determined using the warp and weft yarn counts (i.e. mesh=no. warp/unit width; knock=no. weft/unit length) and yarn diameters/widths that define the pocket boundaries. Pocket length and width are determined using the frame length and width definitions as follows. So, if:

$N_X$=number of weft over which the pocket extends, and $N_M$=number of warp over which the pocket extends, Then:

$$\text{Pocket Length}=[(N_X+1)/PS\ \text{knock})]-(\text{Average of boundary weft diameters})$$

$$\text{Pocket Width}=[(N_M+1)/PS\ \text{mesh})]-(\text{Average of boundary weft diameters}).$$

For a large pocket such as 310 shown in the fabric of FIG. 3, where both the mesh and knock are 45 yarns/in. (1.77 yarns/mm), then if the weft yarn diameter is 0.5 mm and the warp diameter is 0.35 mm, the pocket length and width would be as follows:

$$\text{Pocket Length}=[(2+1)/1.77]-0.5=1.2\ \text{mm}$$

$$\text{Pocket Width}=[(1+1)/1.77]-0.35=0.78\ \text{mm}$$

$$\text{Pocket Open Area(large pocket)}=\text{Pocket Length}\times\text{Pocket Width}=1.2\times0.78=0.94\ \text{mm}^2.$$

A similar calculation shows the open area of a small pocket to be 0.49 $mm^2$.

The ratios of large pocket to small pocket areas is preferably in the range of 1.5:1 to about 4:1.

Those skilled in the art will recognize that a similar arrangement of pockets is also formed on the machine side surface of the fabric 10 with MS warp yarn knuckles formed by warp yarns 1, 3, 5, 7, 9 bounding the sides of the pockets and MS weft yarn knuckles of the weft yarns 1-10 bounding the other sides of the pockets.

While the first preferred embodiment is a 10 shed weave pattern, those skilled in the art will recognize that other sizes of weave patterns having a different number of sheds can be utilized, which would provide a different number of pockets per repeat. Additionally, the size of the warp yarn knuckles and weft yarn knuckles could also be varied to provide pockets of different sizes.

Figures 6, 7:
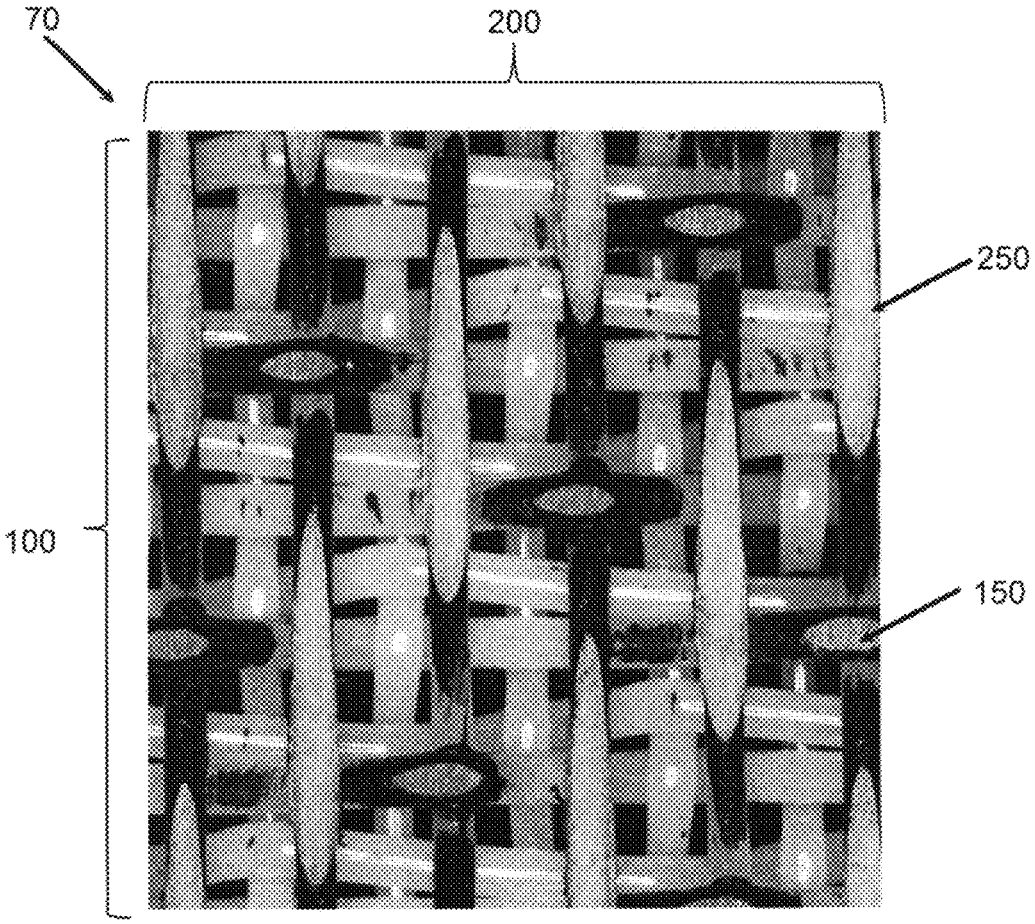
FIG. 6 is a weave diagram of a 10-shed, single layer TAD fabric according to a second embodiment of the invention.
FIG. 7 is a photograph of the PS surface of a fabric woven according to the weave pattern shown in the diagram of FIG. 6.

FIG. 6 is a weave diagram showing a unit cell or pattern square of a second fabric design to be woven in accordance with the teaching of the present invention; the weave diagram provides the weaving, or interlacing, pattern of the warp and weft yarns in one repeat of the fabric weave. As in the weave diagram shown in FIG. 1, the warp yarns are numbered from 1 to 10 across the top of the diagram, while the weft yarns are numbered from 1 to 10 along the left side. In accordance with convention for such diagrams, a black square indicates that a warp yarn is above (or passes over in the repeat) a weft yarn, while a white square indicates that the warp yarn is below a weft yarn at the selected location. It will be apparent to those of skill in the art that the unit cell of FIG. 6 represents one repeat of the weave pattern which is duplicated across the width and the length of the entire fabric; the weave pattern requires 10 sheds in the loom to control the position of the warp yarns, and the pattern repeats over 10 weft, such that an eleventh ($11^{th}$) weft yarn will follow the same interlacing pattern as that shown for weft number 1 at the top of the diagram.

Examination of the weave diagram of FIG. 6 shows that, beginning at the upper left corner of the novel pattern, warp yarn 1 passes over weft yarn 1, then passes under weft yarns 2, 3, 4 and 5, over weft yarn 6, and then under weft yarns 7 through 10; at this point, the path of warp yarn 1 repeats the illustrated pattern beginning from weft yarn 1. The adjacent warp yarn 2 also passes over weft yarn 1, as well as weft yarns 2 and 3, then under weft yarn 4, and then over weft yarns 5 through 10 to complete the pattern. Warp yarns 3, 5, 7 and 9 follow similar paths to that of warp 1, but are offset each to the other by one weft yarn (i.e. the path of warp 1 is repeated, but commences as if shifted "up" in the pattern by one weft). Warp yarns 4, 6, 8 and 10 follow similar paths to that of warp yarn 2, but are also offset, as if shifted "down", by three weft yarns. It is worth noting that the weave pattern shown in FIG. 6 provides a long warp float which spans nine weft yarns in total; this is most apparent by examining the path of warp 10, which forms a continuous unbroken 9 weft float over weft yarns 1 through 9 in the pattern. Unlike fabrics produced according to the weave pattern shown in FIG. 1, the fabric produced using the weave pattern shown in FIG. 6, is not symmetrical, so that the two opposing planar surfaces of the resulting cloth are not identical.

FIG. 7 is a photograph of the PS (paper side) surface of a fabric 70 woven according to the weave pattern shown in FIG. 6; this is the fabric surface which would, when in use, be used to form or convey the paper product that is to be produced using a fabric of the present invention. In FIG. 7, as in FIG. 2, the weft yarns 100 are shown as oriented from left to right across the page, while the warp yarns 200 are oriented vertically down the page. The fabric shown in FIG. 7 has been surfaced (mechanically abraded) so as to increase its surface contact area; note that the result of this surfacing appears as ovals in the warp yarn knuckles such as at 250. In the fabric 70, the weft yarn knuckles such as at 150 have also been surfaced to a lesser extent and appear colored in the photograph to enhance their appearance. This effect is opposite to what occurred in the fabric pattern of FIG. 1 as shown by inspection of FIG. 2 where it is apparent that the weft yarns stood proud of the fabric surface and were subjected to the majority of the surfacing process.

Figure 8:
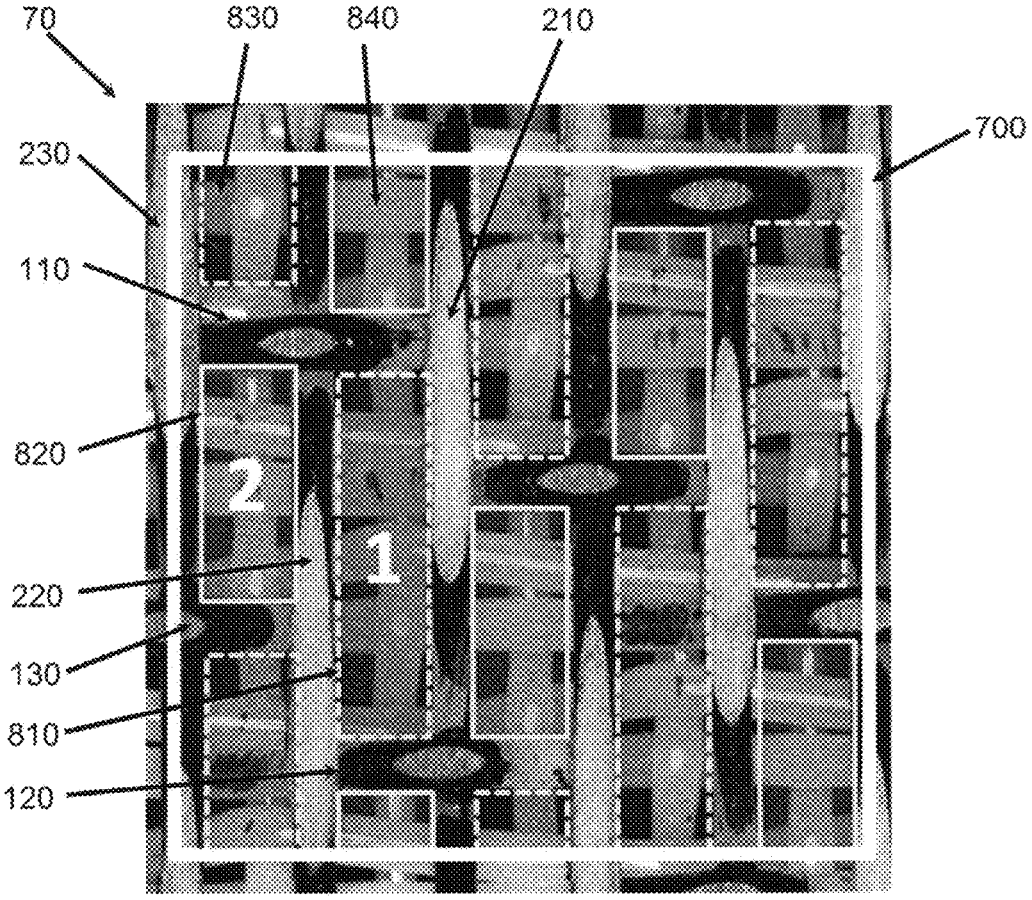
FIG. 8 is a detailed representation of the fabric shown in FIG. 7 which was woven according to the weave diagram shown diagrammatically in FIG. 6 and showing the first and second pockets as formed in the PS surface of the woven fabric.

FIG. 8 presents a photograph of a unit cell 700 superimposed on the fabric sample 70 of FIG. 7 which fabric has been woven according to the pattern presented in FIG. 6 and provides one full repeat of the weave pattern. FIG. 8 also shows in outline the fabric pockets provided by the weave pattern in the unit cell. Inspection of FIG. 8 shows that there are 10 pockets in the unit cell 700, which is a single repeat of the weave pattern; the pockets are of two differing sizes and each is outlined on the PS fabric surface. The first pockets, such as at 810 (indicated with the numeral 1 in FIG. 8), are "larger" pockets, meaning they have a larger open surface area than the second pockets, such as at 820 (indicated with the numeral 2 in the Figure), which are smaller in relation to the first pockets. The larger first pockets are bordered with a dashed line, while smaller second pockets are bordered using a solid line.

Inspection of a larger pocket such as 810 shows that it is bordered on two MD sides by two warp yarn knuckles 210 and 220, and on the other two CD sides by two weft yarn knuckles 110 and 120. The warp yarn knuckles 210 and 220 each "float", or pass over, five weft yarns on the longitudinal edges of larger pocket 810. Thus, pocket 810 is bounded at its upper end by weft yarn knuckle 110, and at the lower end by weft yarn knuckle 120; weft yarn knuckle 120 forms the "end" of warp yarn knuckle 210 while weft yarn knuckle 110 terminates warp yarn knuckle 220. Inspection of warp yarn knuckle 210 in FIG. 8 shows that it floats over 9 consecutive weft yarns beginning at knuckle 120 and extending up the page where it also forms one boundary of the next (smaller) pocket 840. It can also be seen that weft yarn knuckle 110 forms a border of four pockets, including: large pocket 810, small pocket 820, as well as large pocket 830 and small pocket 840. Weft yarn knuckle 110 forms the top boundary of both pockets 810 and 820 where it floats over three warp in succession.

Also as shown in FIG. 8, small pocket 820 is bounded on top by weft yarn knuckle 110, which also forms part of the perimeter of large pocket 810; weft yarn knuckle 130 forms the bottom boundary of small pocket 820; warp floats 220 and 230 form the left and right sides respectively of small pocket 820. Warp float 220 also forms the left boundary of large pocket 810; the pattern continues in the manner just described throughout the fabric.

FIG. 8 thus shows a fabric woven according to the 10-shed pattern of FIG. 6 which provides for 10 pockets of two differing sizes in each unit cell of the fabric. Each pocket is bounded by warp yarn knuckles or floats which pass over 9 consecutive weft yarns to form lateral MD sides of both the large pockets such as 810 and small pockets such as 820. Each pocket is also bounded on two sides by weft yarn knuckles or floats of two weft yarns each of which forms a float as they pass over three weft yarns. Comparison of FIG. 8 with the weave pattern of FIG. 6 clearly shows this float pattern. The "bottoms" of the large pockets such as 810 each include 5 weft yarns and one warp yarn; the bottoms of small pockets such as 320 are formed by one warp yarn and three weft yarn. Thus, it can be seen that each of the first and second pockets is bounded by two warp yarn knuckles and two weft yarn knuckles which are arranged such that:

a) the warp yarn knuckles float over more than 4 weft and, as shown in FIG. 8, up to 9 weft yarns;

b) the weft yarn knuckles float over 3 warp yarns;

c) each warp yarn knuckle defines MD sides of four adjacent pockets, two of which are first pockets, and the remaining two of which are second pockets;

d) each weft yarn knuckle defines CD sides of four adjacent pockets, comprising two first pockets having a first size, and two second pockets having a second size, and e) the first size is not equal to the second size.

While the second preferred embodiment has been described in terms of a 10 shed fabric with a repeat that includes 10 warp yarns and 10 weft yarns, those skilled in the are will recognize that various different numbers of fabric sheds and warp and weft yarns per repeat can be chosen and would be within the scope of the present invention.

FIGS. 9*a*, 10*a*, 11*a*, 12*a* and 13*a* are each weave diagrams of a unit cell or pattern square of third, fourth, fifth, sixth and seventh embodiments of fabrics which may be woven in accordance with the teaching of the present invention. As in the weave diagrams presented in FIGS. 1 and 6, the warp yarns in FIGS. 9*a*, 10*a*, 11*a*, 12*a* and 13*a* are numbered from 1 to 10 across the top of the diagram, while the weft yarns are numbered from 1 to 10 along the left side. In accordance with convention for such diagrams, a black square indicates that a warp yarn is above (or passes over in the repeat) a weft yarn, while a white square indicates that the warp yarn is below a weft yarn at the selected location. It will be apparent that the unit cells of FIGS. 9*a*, 10*a*, 11*a*, 12*a* and 13*a* each represent one repeat of the indicated weave pattern which is duplicated across the width and the length of the entire fabric; the weave patterns of each diagram all require 10 sheds in the loom to control the position of the warp yarns, and the patterns repeat over 10 weft, such that an eleventh ($11^{th}$) weft yarn will follow the same interlacing pattern as that shown for weft number 1 at the top of the diagrams.

Examination of the weave diagram of FIG. 9*a* shows that, beginning at the upper left corner, warp yarn 1 passes over weft yarn 1, then passes under weft yarns 2 through 10; at this point, the path of warp yarn 1 repeats the illustrated pattern beginning from weft yarn 1. The adjacent warp yarn 2 also passes over weft yarn 1, as well as weft yarns 2 and 3, then under weft yarn 4, and then over weft yarns 5 through 10 to complete the pattern. Warp yarns 3, 5, 7 and 9 follow similar paths to that of warp 1, but are offset each to the other by three weft yarns. Warp yarns 4, 6, 8 and 10 follow similar paths to that of warp yarn 2, but are also offset, as if shifted "down", by three weft yarns. The weave pattern shown in FIG. 9*a* provides a long warp float which, like that presented in FIG. 6, has a float length of nine weft yarns; this is most readily apparent by examining the path of warp yarn 10 at the far right of the FIG. 9*a* weave diagram, which can be seen to pass over weft yarns 1 through 9. The fabric produced using the weave pattern shown in FIG. 9*a* is symmetrical, so that the two opposing planar surfaces of the resulting cloth are identical, similar to FIG. 1 as previously discussed.

FIG. 9*b* is a planar view of a representation of a fabric 900 woven according to the weave pattern of FIG. 9*a*; a single repeat of the pattern square 901 is indicated at the upper left corner of the representation. The pattern square 901 corresponds to the weave diagram of FIG. 9*a*; FIG. 9*b* shows the appearance of four repeats of the FIG. 9*a* weave pattern. In FIG. 9*b*, the warp yarns 200 are oriented vertically in the representation, while the weft yarns 100 are arranged horizontally across the representation. Four exemplary pockets 910, 912, 914 and 916 are identified in the pattern square 901; pockets 910 and 916 are both large pockets, meaning they have a larger open surface area than the small pockets, such as 912 and 914, which are smaller in relation to the large pockets. Inspection of the pattern square 901 shows there are 5 small pockets such as 912 and 914, and 5 large pockets such as 910 and 916 within the pattern square 901.

Inspection of a large pocket such as 910 shows that it is bordered on each side by two warp yarn knuckles and, at the top and bottom, by two weft yarn knuckles each of which float over three consecutive warp yarns in the pattern as previously discussed in relation to FIGS. 1 and 6. Each large pocket such as 910 is bordered on the left and right by a warp yarn knuckle that floats over 5 weft yarns. Each small pocket such as 914 is bordered by a warp yarn knuckle which floats over three weft yarns. The warp and weft yarn knuckles of the large and small pockets each share a common boundary with adjacent small and large pockets, as is apparent from the representation of FIG. 9*b*. An isometric representation of the fabric 900 presented in planar view in FIG. 9*b* is provided in FIG. 9*c*. In FIG. 9*c*, the weft yarns are collectively identified as 100 while the warp yarns are collectively identified as 200. As can be seen in this representation, the fabric 900 has a semi-duplex construction similar to that exhibited in the fabric of FIG. 5 so that alternate warp yarns form floats on each of the first and second surfaces of the fabric.

FIG. 10*a* presents a weave diagram of a fabric according to a fourth embodiment of the present invention. As shown in the diagram, beginning at the upper left corner, warp yarn 1 passes over weft yarns 1 and 2, then passes under weft yarns 3 through 10; at this point, the path of warp yarn 1 repeats the illustrated pattern beginning from weft yarn 1. The adjacent warp yarn 2 passes over weft yarns 1, 2 and 3, then under weft yarn 4, and then over weft yarns 5 through 10 to complete the pattern. Warp yarns 3, 5, 7 and 9 follow similar paths to that of warp 1, but are offset each to the other by two weft yarns. Warp yarns 4, 6, 8 and 10 follow similar paths to that of warp yarn 2, but are also offset, as if shifted "down", by three weft yarns. The weave pattern shown in FIG. 10*a* thus provides a long warp float which nine spans consecutive weft yarns in total; this is most apparent by examining the path of warp 10 in FIG. 10*a*, which forms a 9 weft float over weft yarns 1 through 9. The fabric produced using the weave pattern shown in FIG. 10*a* is not symmetrical, so that the two opposing planar surfaces of the resulting cloth are not identical, similar to FIG. 6 as previously discussed.

FIG. 10*b* is a planar view of a representation of a fabric 1000 represented as if woven according to the weave pattern shown in FIG. 10*a*; a single repeat of the pattern square provided in FIG. 10*a* is indicated as 1001 at the upper left corner of the representation. Four repeats of the weave pattern of FIG. 10*a* are shown in the representation of FIG. 10*b*. In FIG. 10*b*, the warp yarns 200 are oriented vertically in the representation, while the weft yarns 100 are arranged horizontally across the representation. Four exemplary pockets 1010, 1012, 1014 and 1016 are identified in the pattern square 1001; pockets 1010 and 1016 are both large pockets, meaning they have a larger open surface area than the small pockets, such as 1012 and 1014, which are smaller in relation to the large pockets. Inspection of the pattern square 1001 shows there are 5 small pockets such as 1012 and 1014, and 5 large pockets such as 1010 and 1016.

Inspection of a large pocket such as 1010 shows that it is bordered by two warp yarn knuckles and two weft yarn knuckles. The weft yarns 100 each float over three consecutive warp yarns as they form the upper and lower boundaries of both the large and small pockets in the manner previously discussed in relation to FIGS. 1 and 6. Each large pocket such as 1010 is bordered on the left and right by a warp yarn knuckle that floats over 5 weft yarns. Each small pocket such as 1014 is bordered by a warp yarn knuckle which floats over three weft yarns. The warp and weft yarn knuckles of the large and small pockets each share a common boundary with adjacent small and large pockets, as is apparent from the representation of FIG. 10*b*. An isometric representation of the fabric 1000 shown in FIG. 10*b* is provided in FIG. 10*c*. In FIG. 10*c*, as in FIGS. 9*b* and 9*c*, the weft yarns are collectively identified as 100 while the warp yarns are collectively identified as 200. The representation of FIG. 10*c* shows that the fabric has a semi-duplex construction similar to that of the earlier first, second and third embodiments of the invention.

FIG. 11*a* is a weave diagram of a fifth embodiment of a 10-shed semi-duplex fabric of the present invention. As shown in the diagram, beginning at the upper left corner, warp yarn 1 passes under weft yarns 1, 2 and 3, then passes over weft yarn 4, under weft 5, 6, 7 and 8, over weft yarn 9 and under weft 10, at which the point the pattern repeats from weft yarn 1. This interweaving pattern is repeated for warps 3, 5, 7 and 9 but each is offset in the pattern to the other by two weft yarns. Adjacent warp yarn 2 passes over weft yarn 1, under 2, then over wefts 3 through 6, under weft 7, and over weft 8, 9 and 10 at which point the interweaving arrangement of this yarn repeats. Warp yarns 4, 6, 8 and 10 follow similar paths to that of warp yarn 2, but are also offset, as if shifted "down", by two weft yarns. The weave pattern shown in FIG. 11*a* thus provides for two warp yarn floats in the repeat, each of which floats over 4 weft yarns; this is most apparent by examining the path of warp 10, which forms a 4 weft float over weft yarns 1 through 4 and 6 through 9. The fabric produced using the weave pattern shown in FIG. 11*a* is symmetrical, so that the two opposing planar surfaces of the resulting cloth are identical, similar to that of FIG. 1 as previously discussed.

FIG. 11*b* is a planar view of a representation of a fabric 1100 represented as if woven according to the weave pattern shown in FIG. 11*a*; a single repeat of the pattern square provided in FIG. 11*a* is indicated as 1101 at the upper left corner of the representation of FIG. 11*b*. Four repeats of the weave pattern of FIG. 11*a* are shown in the representation of FIG. 11*b*. In FIG. 11*b*, the warp yarns 200 are oriented vertically in the representation, while the weft yarns 100 are arranged horizontally across the representation. Four exemplary pockets 1110, 1112, 1114 and 1116 are identified in the pattern square 1101; pockets 1110 and 1116 are both large pockets, meaning they have a larger open surface area than the small pockets, such as 1112 and 1114, which are smaller in relation to the large pockets. Inspection of the pattern square 1001 shows there are 10 small pockets such as 1112 and 1114, and 10 large pockets such as 1110 and 1116.

Inspection of a large pocket such as 1110 shows that it is bordered by two warp yarn knuckles and two weft yarn knuckles. The weft yarns 100 forming the upper and lower boundaries of both the large and small pockets each float over three consecutive warp yarns in the pattern, in the manner previously discussed. Each large pocket such as 1110 is bordered on the left and right by a warp yarn knuckle that floats over 2 weft yarns before reaching a weft knuckle. Each small pocket such as 1112 is bordered by a warp yarn knuckle which floats over one weft yarn. One side of each of pockets 1110 and 1112 share a warp float that extends over 4 weft yarns. The upper boundary of small pocket 1112, for example, is formed by a float of weft yarn 4 as it passes over warps 3, 4 and 5 (see FIG. 11*a*). The lower boundary is formed by a float of weft yarn 6 as it passes over warps 5, 6 and 7; weft yarn 6 also forms the upper boundary of large pocket 1110, which is bordered on the left by a float of warp yarn 4, which floats terminates at the bottom of the pocket when it passes beneath a float of weft yarn 9 as shown in FIG. 11*a*. The warp and weft yarn knuckles of the large and small pockets each share a common boundary with adjacent small and large pockets, as is apparent from the representation of FIG. 11*b*. An isometric representation of the fabric 1100 shown in FIG. 11*b* is provided in FIG. 11*c*. In FIG. 11*c*, as in the previous Figures such as 9*b* and 9*c*, the weft yarns are collectively identified as 100 while the warp yarns are collectively identified as 200. The representation of FIG. 11*c* shows that the fabric has a semi-duplex construction similar to that of the earlier embodiments of the invention as have been previously described.

FIG. 12*a* is a weave diagram of a fabric according to a sixth embodiment of the invention. Examination of the weave diagram of FIG. 12*a* shows that, beginning at the upper left corner, warp yarn 1 passes under weft yarn 1, then passes over the remaining weft 2 through 10 in the pattern to form a float over those 9 yarns; at this point, the path of warp yarn 1 repeats the illustrated pattern beginning from weft yarn 1. Warp yarn 2 passes under weft yarns 1 through 3, over weft 4, and then under remaining weft 5 through 10 to complete the pattern. Warp yarns 3, 5, 7 and 9 follow similar paths to that of warp 1, but are offset each to the other by three weft yarns. Warp yarns 4, 6, 8 and 10 follow similar paths to that of warp yarn 2, but are also offset, as if shifted "up" by three weft yarns. The weave pattern shown in FIG. 11*a* thus provides a long warp float which, like that presented in FIG. 6, has a float length of nine weft yarns; this is most readily apparent by examining the path of warp yarn 1 at the far left of the FIG. 12*a* weave diagram which, as shown, passes over weft yarns 2 through 10. The fabric produced using the weave pattern shown in FIG. 12*a* is symmetrical, so that the two opposing planar surfaces of the resulting cloth are identical, similar to FIG. 1 as previously discussed.

FIG. 12*b* is a planar view of a representation of a fabric 1200 woven according to the weave pattern of FIG. 12*a*; a single repeat of the pattern square 1201 is indicated at the upper left corner of the representation 1200. The pattern square 1201 corresponds to the weave diagram of FIG. 12*a* and shows the appearance of the yarns as if interwoven according to the pattern of FIG. 12*a*. FIG. 12*b* shows the appearance of four repeats of the FIG. 12*a* weave pattern. In FIG. 12*b*, the warp yarns 200 are oriented vertically in the representation, while the weft yarns 100 are arranged horizontally across the representation. Four exemplary pockets 1210, 1212, 1214 and 1216 are identified in the pattern square 1201; pockets 1210 and 1216 are both large pockets, meaning they have a larger open surface area than the small pockets, such as 1212 and 1214, which are smaller in relation to the large pockets. Inspection of the pattern square 1201 shows there are 5 small pockets such as 1212 and 1214, and 5 large pockets such as 1210 and 1216.

Inspection of a large pocket such as 1210 shows that it is bordered by two warp yarn knuckles and two weft yarn knuckles. The weft yarns 100 forming the upper and lower boundaries of pocket 1210 each float over three consecutive warp yarns in the pattern, forming the upper and lower boundaries of both the large and small pockets such as 1212, 1214 and 1216 in the manner previously discussed in relation to FIGS. 1 and 6. Each large pocket such as 1210 is bordered on the left and right by a warp yarn knuckle that floats over 5 weft yarns. Each small pocket such as 1214 is bordered by a warp yarn knuckle which floats over three weft yarns. The warp and weft yarn knuckles of the large and small pockets each share a common boundary with adjacent small and large pockets, as is apparent from the representation of FIG. 12*b*. An isometric representation of the fabric 1200 is provided in FIG. 12*c*. In FIG. 12*c*, the weft yarns are collectively identified as 100 while the warp yarns are collectively identified as 200. As can be seen in this representation, the fabric 1200 has a semi-duplex construction similar to that exhibited in the fabric of FIG. 5.

FIG. 13*a* is a weave diagram of a fabric according to a seventh embodiment of the invention. Examination of the weave diagram of FIG. 12*a* shows that, beginning at the upper left corner, warp yarn 1 passes under weft yarn 1, then passes over the remaining weft 2 through 10 in the pattern to form a float over those 9 yarns; at this point, the path of warp yarn 1 repeats the illustrated pattern beginning from weft yarn 1. Warp yarn 2 passes under weft yarns 1 through 3, over weft 4, under weft yarns 5, 6, 7 and 8, over weft 9, and then under weft yarn 10 to complete the pattern. Warp yarns 3, 5, 7 and 9 follow similar paths to that of warp 1, but are offset each to the other by three weft yarns. Warp yarns 4, 6, 8 and 10 follow similar paths to that of warp yarn 2, but are also offset, as if shifted "down" by one weft yarn. The weave pattern shown in FIG. 13*a* thus provides a long warp float which, like that presented in FIGS. 6, 9*a* and 12*a* has a float length of nine weft yarns; this is most readily apparent by examining the path of warp yarn 1 at the far left of the FIG. 13*a* weave diagram in which warp 1 passes over weft yarns 2 through 10 to provide a float length of 9 yarns. The fabric produced using the weave pattern shown in FIG. 13*a* is not symmetrical, so that the two opposing planar surfaces of the resulting cloth are not identical, similar to FIG. 6 as previously discussed.

FIG. 13*b* is a planar view of a representation of a fabric 1300 woven according to the weave pattern of FIG. 13*a*; a single repeat of the pattern square 1301 is indicated at the upper left corner of the representation 1300. The pattern square 1301 corresponds to the weave diagram of FIG. 13*a* and shows the appearance of the yarns as if interwoven according to the pattern of FIG. 13*a*. FIG. 13*b* shows the appearance of four repeats of the FIG. 13*a* weave pattern. In FIG. 13*b*, the warp yarns 200 are oriented vertically in the representation, while the weft yarns 100 are arranged horizontally across the representation. Four exemplary pockets 1310, 1312, 1314 and 1316 are identified in the pattern square 1301; pockets 1310 and 1316 are both large pockets, meaning they have a larger open surface area than the small pockets, such as 1312 and 1314, which are smaller in relation to the large pockets. Inspection of the pattern square 1301 shows there are 5 small pockets such as 1312 and 1314, and 5 large pockets such as 1310 and 1316. Each small pocket includes 3 weft yarns and one warp yarn forming the pocket bottom. While each large pocket includes 5 weft yarns and 1 warp yarn in the pocket bottom.

Inspection of a large pocket such as 1310 shows that it is bordered on each side by two warp yarn knuckles and across the top and bottom by two weft yarn knuckles. The weft yarns 100 each float over three consecutive warp yarns in the pattern, forming the upper and lower boundaries of both the large and small pockets in the manner previously discussed in relation to FIGS. 1 and 6. Each large pocket such as 1310 is bordered on the left and right by a warp yarn knuckle that floats over 5 consecutive weft yarns. Each small pocket such as 1312 is bordered by a warp yarn knuckle which floats over three consecutive weft yarns. The warp and weft yarn knuckles of the large and small pockets each share a common boundary with adjacent small and large pockets, as is apparent from the representation of FIG. 13*b*. An isometric representation of the fabric 1300 is provided in FIG. 13*c*. In FIG. 13*c*, the weft yarns are again collectively identified as 100 while the warp yarns are collectively identified as 200. As can be seen in this representation, the fabric 1300 has a semi-duplex construction similar to that exhibited in the fabric of FIG. 5.

As previously mentioned, the fabrics of the present invention are typically woven using either circular or generally rectangular cross-sectional shaped warp and weft yarns. Round cross-sectional yarns are preferred for use as both the warp and weft yarns, however, either can be used in any desired combination depending upon the intended end use of the fabric and facilities and equipment available to the fabric manufacturer. Generally, circular cross-section warp yarns having a diameter of about 0.35 mm can be used, however the selected warp yarn diameter may range from as low as about 0.22 mm to as high as about 0.45 mm, with the fabric mesh in the range of about 44 to 46 warp yarns per inch (17.3 to 18.1 warp yarns/cm). The weft yarns will generally also be of circular cross-sectional shape, with diameter ranging from about 0.3 mm to about 0.8 mm, woven at a knocking of from about 30 to 60 weft/in. (11.8 to 23.6 weft yarns/cm). The woven fabric may be subjected to a surfacing process to increase its PS surface contact area to a desired level following weaving; surface areas of about 15% to 20% are typical, however, the fabric may be surfaced to provide a contact area of as much as 30% depending on need. When generally rectangular cross-sectional shaped yarns are used, this surfacing step may be eliminated depending on the contact area achieved and end use requirements, or at least significantly reduced. The resulting fabrics will desirably have an air permeability that is at least 600 cfm (cubic feet per minute) and is preferably higher.

The fabrics of the invention preferably exhibit pockets of two differing sizes in the PS surface which pockets are generally MD oriented. We have found that MD oriented pockets tend to provide a tissue or towel product which may exhibit improved tactile properties, such as softness, in comparison to similar products formed using a fabric in which the pockets are predominantly CD oriented.

Following manufacture, the fabrics of the invention may be treated with a contaminant resistant coating so as to improve their ability to run "clean" and to shed undesirable particulate matter and chemical deposits such as may be present in the papermaking environment.

What is claimed is:

1. A woven through-air dryer (TAD) fabric, which fabric is woven according to a repeat pattern so as to provide a fabric having first and second generally planar surfaces, a machine direction and a cross-machine direction which directions are mutually perpendicular and coplanar with the first and second surfaces, wherein in the pattern repeat, warp and weft yarns are interwoven to provide a plurality of warp and weft yarn knuckles forming the first generally planar fabric surface and, pockets defined between two adjacent pairs of warp and weft yarn knuckles, the pockets having an area that is defined by the pairs of warp and weft yarn knuckles and a depth which is recessed below the first planar surface, wherein in each repeat of the pattern:

a) the pockets are comprised of first pockets having a first open area exposed on the first fabric surface and second pockets having a second open area exposed on the first fabric surface;

b) the bottom surface of each of the pockets is defined by a single one of the warp yarns and at least one of the weft yarns and is recessed below the generally planar first fabric surface;

c) a perimeter of each of the first and second pockets is defined by two of the warp yarn knuckles and two of the weft yarn knuckles;

d) each of the warp yarn knuckles defining the perimeter of a respective one of the first and second pockets is separated from an adjacent one of the warp yarn knuckles defining the perimeter of said respective one of the first and second pockets by a single one of the warp yarns;

e) a number of the first pockets in the pattern repeat is equal to a number of the second pockets;

f) the open area defined by the perimeter of the first pockets is different from the open area defined by the perimeter of the second pockets;

g) the first pockets and the second pockets are both arranged in a diagonal twill pattern on the first fabric surface;

h) the two warp yarn knuckles and the two weft yarn knuckles defining the perimeters of each of the first and second pockets are arranged such that:

i. the warp yarn knuckles float over from 4 to 9 of the weft yarns;

ii. the weft yarn knuckles float over 3 of the warp yarns;

iii. each of the warp yarn knuckles defines machine direction (MD) sides of two of the first pockets and two of the second pockets; and iv. each of the weft yarn knuckles defines cross-machine direction (CD) sides of two of the first pockets and two of the second pockets.

2. A fabric according to claim 1 wherein the repeat pattern is a 10-shed pattern requiring 10 warp and 10 weft yarns in each repeat, and the repeat pattern provides N pockets on at least the first generally planar fabric surface, and N is an integer ≥10.

3. A fabric according to claim 1 which is symmetrical such that the repeating pattern provided to the first and second generally planar surfaces is identical.

4. A fabric according to claim 1 wherein, within one repeat of the weave pattern in the fabric, alternate ones of the warp yarns form the knuckles that define the perimeters of the first and second pockets on only one of the two generally planar surfaces.

5. A fabric according to claim 4 wherein the alternate warp yarns provide the knuckles that define the perimeters of the first and second pockets to the first generally planar surface of the fabric.

6. A fabric according to claim 5 wherein the first generally planar surface is the paper side surface (PS) of the fabric.

7. A fabric according to claim 1 wherein the warp yarn knuckles that define the perimeters of the first and second pockets float over at least 4 of the weft yarns on the first generally planar surface of the fabric.

8. A fabric according to claim 2 wherein the warp yarn knuckles in a single repeat float over 9 weft yarns.

9. A fabric according to claim 1 wherein each of the warp yarn knuckles forms the MD sides of four of the pockets.

10. A fabric according to claim 9 wherein the warp yarn knuckles form the MD sides of two of the first pockets and two of the second pockets which are mutually adjacent to one another.

11. A fabric according to claim 10 wherein the first and second pockets are separated in the MD by one of the weft yarn knuckles.

12. A fabric according to claim 1 wherein the weft yarn knuckles that define the perimeters of the first and second pockets float over three of the warp yarns.

13. A fabric according to claim 1 wherein each of the pockets is separated in the CD from an adjacent one of the pockets by one of the warp yarns.

14. A fabric according to claim 1 wherein each of the pockets is separated in the MD from the adjacent pocket by one of the weft yarns.

15. A fabric according to claim 1 wherein each of the pockets is separated from an adjacent one of the pockets by one of the warp yarn knuckles and one of the weft yarn knuckle.

16. A fabric according to claim 1 wherein each of the warp yarn knuckles is separated in the CD from an adjacent one of the warp yarn knuckles on the same fabric surface by one of the warp yarns.

17. A fabric according to claim 2 wherein 50% of the warp yarns float over 8 of the weft yarns in one repeat of the weave pattern so as to form two of the warp yarn knuckles on one of the two fabric surfaces, where each of said warp yarn knuckles floats over 4 of the weft yarns.

18. A fabric according to claim 2 wherein 50% of the warp yarns float over 9 of the weft yarns in one repeat of the weave pattern so as to form one warp yarn knuckle on one of the fabric surfaces.

19. A fabric according to claim 1 wherein 50% of the warp yarns in one repeat of the weave pattern form the warp yarn knuckles on one surface of the fabric.

20. A fabric according to claim 1 where the warp yarns have a generally circular cross-sectional configuration.

21. A fabric according to claim 1 wherein the warp yarns have a generally rectangular cross-sectional configuration whose aspect ratio, measured as the yarn width multiplied by the yarn thickness is at least 1.4:1.

22. A fabric according to claim 1 wherein across-sectional configuration of the weft yarns is selected from: generally circular, ovate and generally rectangular.

23. A fabric according to claim 22 wherein the cross-sectional configuration of the weft yarns is generally circular.

24. A fabric according to claim 1 wherein at least one of the first and second generally planar surfaces is subjected to an abrasive surfacing treatment.

25. A fabric according to claim 24 wherein a surface contact area of the fabric is at least 14%.

26. A fabric according to claim 1 wherein the fabric seam is selected from: a woven back seam, a pin seam, or a coil seam.

27. A fabric according to claim 1 wherein at least one of the warp or the weft yarns is extruded from a thermoplastic fiber forming polymer selected from: a polyester, a hydrolysis stabilized polyester, a polyphenylene sulfide, or a polyetheretherketone.

28. A fabric according to claim 1 wherein the fabric is subjected to a surfacing treatment to increase a PS contact area with the product to be conveyed.

29. A fabric according to claim 28 wherein the PS contact area is from about 15% to about 30%.

30. A fabric according to claim 1 further including a contaminant resistant coating.

31. A papermaker's fabric comprising:

a fabric woven from a system of warp yarns and a system of weft yarns to define first and second generally planar surfaces corresponding to a paper support surface and a machine side surface, the warp and weft yarns are interwoven to provide a plurality of warp and weft yarn knuckles forming the first generally planar fabric surface and pockets are defined between two adjacent pairs of the warp and the weft yarn knuckles on each of the first and second generally planar surfaces, the pockets having an area that is defined by the pairs of the warp and the weft yarn knuckles and a depth which is recessed below the first planar surface;

the warp yarn knuckles of a first group of warp yarns consisting of alternate ones of the warp yarns form warp sides of all of the pockets on the paper support surface of the fabric and exclusively form warp bottoms of the pockets on the machine side surface of the fabric;

the warp yarn knuckles of a second group of warp yarns consisting of the remaining warp yarns that are not in the first group form warp sides of all of the pockets on the machine side surface and exclusively form warp bottoms of the pockets on the paper support surface;

the warp yarn knuckles that form the sides of the pockets float over from 4 to 9 weft yarns; and the weft yarn knuckles that form remaining sides of the pockets float over 3 warp yarns on each of the paper support and machine side surfaces.

32. A fabric according to claim 31 wherein the pockets on each of the fabric surfaces are of two different sizes.

33. A fabric according to claim 31 wherein each of the warp yarn knuckles forms the sides of 4 of the pockets.

34. A fabric according to claim 31 wherein each of the weft yarn knuckles forms the sides of 4 of the pockets.

35. A fabric according to claim 31 wherein the pockets on each of the surfaces of the fabric are separated from adjacent ones of the pockets by a single one of the yarns in each direction.

36. A fabric according to claim 31 wherein opposite corners of each of the pockets are formed by the warp yarn knuckles, and other opposite corners formed by the weft yarn knuckles.

* * * * *